US009346067B2

(12) United States Patent
Ito et al.

(10) Patent No.: US 9,346,067 B2
(45) Date of Patent: May 24, 2016

(54) SPRAY GUN

(71) Applicant: SUMITOMO RIKO COMPANY LIMITED, Komaki-shi, Aichi (JP)

(72) Inventors: Keisuke Ito, Nagoya (JP); Masayuki Tsuneoka, Komaki (JP)

(73) Assignee: SUMITOMO RIKO COMPANY LIMITED, Komaki-shi (JP)

( * ) Notice: Subject to any disclaimer, the term of this patent is extended or adjusted under 35 U.S.C. 154(b) by 0 days.

(21) Appl. No.: 14/688,391

(22) Filed: Apr. 16, 2015

(65) Prior Publication Data

US 2015/0217309 A1 Aug. 6, 2015

Related U.S. Application Data

(63) Continuation of application No. PCT/JP2013/078820, filed on Oct. 24, 2013.

(30) Foreign Application Priority Data

Oct. 29, 2012 (JP) ..... 2012-238205

(51) Int. Cl.
*B05B 7/12* (2006.01)
*B05B 7/06* (2006.01)
*B05B 7/08* (2006.01)

(52) U.S. Cl.
CPC ..... *B05B 7/067* (2013.01); *B05B 7/0815* (2013.01); *B05B 7/1254* (2013.01); *B05B 7/1272* (2013.01)

(58) Field of Classification Search
CPC ..... B05B 7/067; B05B 1/30; B05B 7/12; B05B 7/265; B05B 7/0075
USPC ..... 239/417.3, 525, 569
See application file for complete search history.

(56) References Cited

U.S. PATENT DOCUMENTS 6,494,387 B1 12/2002 Kaneko
2002/0195505 A1 12/2002 Haruch et al.

FOREIGN PATENT DOCUMENTS

JP H03-21360 A 1/1991
JP H06-46523 Y2 11/1994
JP 2665246 B2 10/1997
JP H09-511680 A 11/1997
JP 2890438 B2 5/1999
JP 2003-062490 A 3/2003
JP 2008-012403 A 1/2008
JP 005102553 B2 * 12/2012 ..... B05B 7/607

OTHER PUBLICATIONS

Jan. 28, 2014 International Search Report issued in PCT/JP2013/078820.

* cited by examiner

*Primary Examiner* — Davis Hwu
(74) *Attorney, Agent, or Firm* — Oliff PLC

(57) ABSTRACT

A spray gun including: a nozzle provided with a fixed-side restricting section; a needle valve inserted inside the nozzle and provided with a valve portion such that an aperture is formed radially therebetween; an elastic seal member that comes in contact and is elastically deformed in an axial direction between the nozzle and the needle valve; and a straight joint formed by a female joint provided on a nozzle hole of the nozzle and a male joint provided on the valve portion. The straight joint is arranged such that the male joint fits inside the female joint before the elastic seal member comes in contact between the nozzle and the needle valve as well as after the aperture becomes the smallest, and the jointed state is retained until the elastic seal member comes in contact and is elastically deformed therebetween.

7 Claims, 16 Drawing Sheets

$S_1 = 0 < S_2$ $L_1 = 0$ $S_1 = S_2 = 0$ (AMOUNT OF FLEXURE 0mm)

$S_1 = S_2 = 0$ (AMOUNT OF FLEXURE 0.15mm)

FIG.6A COMPARATIVE EXAMPLE
AMOUNT OF DISCHARGE : a mg/s
APERTURE : 0.062mm
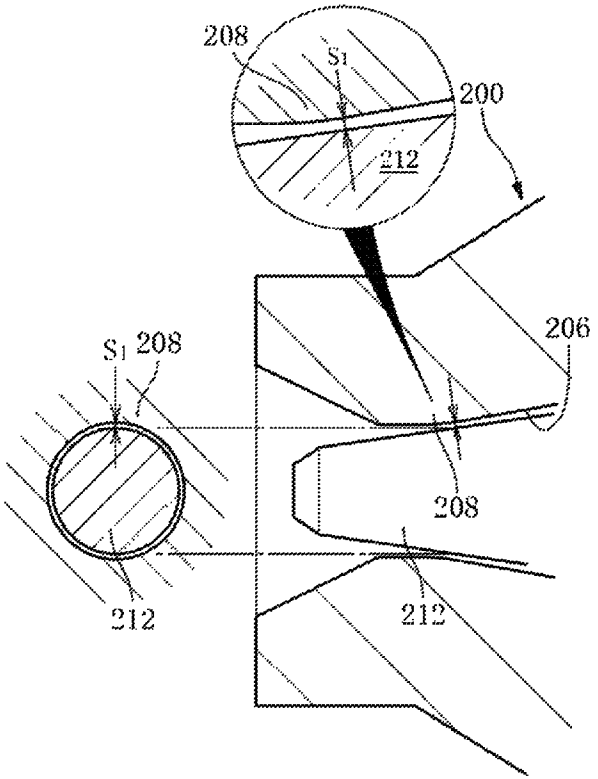
FIG.6B EMBODIMENT
AMOUNT OF DISCHARGE : a mg/s
APERTURE : 0.146mm
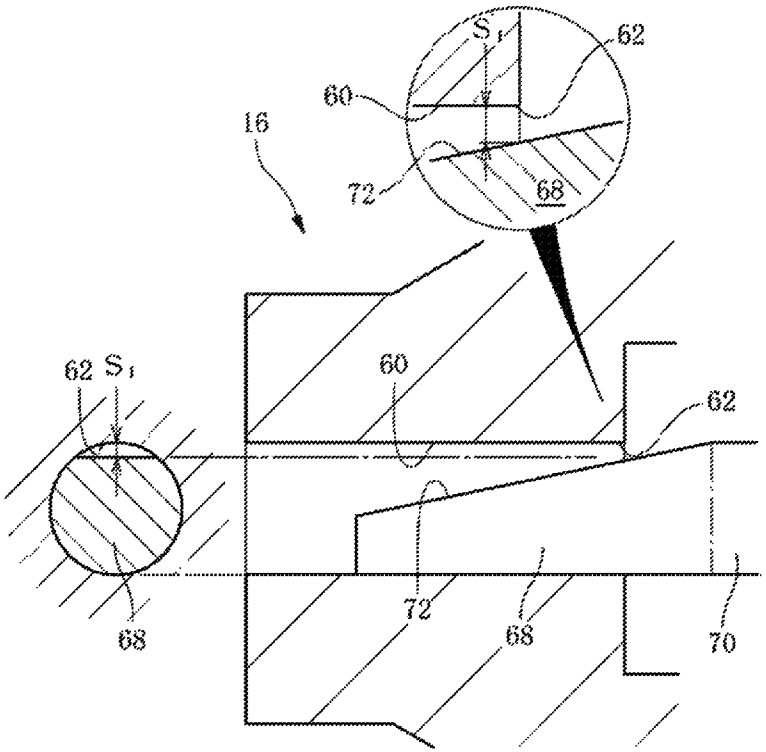

SPRAY GUN

INCORPORATED BY REFERENCE

The disclosure of Japanese Patent Application No. 2012-238205 filed on Oct. 29, 2012 including the specification, drawings and abstract is incorporated herein by reference in its entirety. This is a Continuation of International Application No. PCT/JP2013/078820 filed on Oct. 24, 2013.

BACKGROUND OF THE INVENTION

1. Field of the Invention

This invention relates to a spray gun that atomizes an adhesive agent, paint or other liquid and sprays it on the target object, and is specifically characterized by its needle valve mechanism.

2. Description of the Related Art

Conventionally, spray guns are widely used to spray adhesive agents, paint, and other types of liquids in order to coat the target object. Known as spray guns of that type are "air spray guns" that use a jet stream of air to atomize the liquid during spray coating and "airless spray guns" that spray liquid as a mist by adding pressure to the liquid in order to spray coat the target object. With such spray guns, those that have a needle valve and use that needle valve to adjust the volume of liquid flow are generally used.

In particular, a conventional spray gun is equipped with a tubular nozzle that contains the outlet for the liquid in its tip and a needle valve that is inserted inside that nozzle. A fixed-side restricting section is provided inside the nozzle on its inner circumference, and an aperture is formed around the needle valve for the liquid to pass through between the needle valve and the restricting section. That aperture is enlarged along with the retracting movement of the needle valve and the aperture is narrowed along with its forward movement. A valve portion is provided on the tip of the needle valve and serves as a movable-side restricting section that changes the amount of liquid that reaches the outlet through that aperture. In this way, the forward and retracting movement of the needle valve is used to adjust the volume of liquid flow coming from the outlet, and it is possible to spray coat the target object with that liquid by making the compressed air that is emitted from the air jetting port collide with the liquid that is discharged from the outlet, or by atomizing the liquid through pressure that is added to the liquid.

The main parts of an example of an air spray gun that atomizes liquid with a jet stream of air for spray coating are concretely illustrated in FIGS. 14A to 14C. A nozzle 200 of an air spray gun is shown in FIG. 14A, with a liquid passage 202 having an annular cross section being formed between the nozzle 200 and a needle valve 210. The nozzle 200 includes a round outlet 204 at its tip where liquid is discharged, and then, to the rear of the outlet 204, includes a female tapered surface 206 having a circular cross section. The female tapered surface 206 forms fixed-side restricting section 208 at a part of its tip end. The needle valve 210 is a narrow-shaft (needle-shape) component with a circular cross section, its tip is specified as male taper-shaped valve portion 212, and the outer peripheral surface of this valve portion 212 is specified as a male tapered surface 214 whose diameter becomes progressively smaller toward its tip.

The needle valve 210 is made movable on the central axis of the nozzle 200 in the axial direction (the left-right direction in FIG. 14A) and, through its forward movement, the aperture with a ring-shaped cross section between the valve portion 212 and the fixed-side restricting section 208, which serves as a valve seat, is narrowed in the radial direction. And, at its forward end, by having the valve portion 212, specifically the male tapered surface 214, come in contact with the restricting section 208 in the axial direction, that aperture in the radial direction is closed over the entire the circumference. In other words, the liquid passage 202, which extends to the outlet 204, can be blocked and closed. Meanwhile, the aperture with a ring-shaped cross section is produced between the valve portion 212 and the restricting section 208 along with the retracting movement of the needle valve 210, and the aperture is then further enlarged in the radial direction by the continued retracting movement of the needle valve 210. The amount of liquid that passes through that aperture is thus adjusted in accordance with the change in the size of that aperture. In other words, the amount of liquid that is discharged from the outlet 204 is changed. Here, a cap 216 is provided on the periphery of the tip of the nozzle 200, separated from it by a designated distance, thus forming an air passage 218 with an air jetting port 220 located between this cap 216 and the nozzle 200.

With this air spray gun, liquid is drawn out of the outlet 204 by the air jet stream from the air jetting port 220. In other words, the liquid is discharged from the outlet 204. Furthermore, that discharged liquid is atomized into a mist through a collision with the compressed air. And, as is schematically shown in FIG. 15, the particles of the atomized liquid ride the air jet stream and are spray coated onto the target object. The example illustration in FIG. 15 shows a case wherein liquid is spray coated onto a small target object W (described later).

Here, with a conventional air spray gun 222, wherein the valve portion 212 comes in contact with the restricting section 208 of the nozzle 200 in the axial direction at the forward end of the needle valve 210 to close the liquid passage 202, there is the problem that, depending on the dimensional tolerance of the restricting section 208 and the valve portion 212 when the liquid passage 202 is closed, microscopic gaps are generated between the valve portion 212 and the restricting section 208. This kind of problem with a conventional air spray gun is indicated, for example, in Japanese Unexamined Patent Publication No. JP-A-2008-012403. Another problem with microscopic gaps being generated due to the fiber contained in the liquid getting caught between the valve portion 212 and the restricting section 208 when the liquid passage 202 is closed is also indicated in Japanese Examined Utility Model Publication No. JP-Y-6-046523.

There are also the problems of the contact between the restricting section 208 of the nozzle 200 and the valve portion 212 of the needle valve 210 resulting in uneven wear and damage to the restricting section 208 and the valve portion 212, both of which are made of metal, when the liquid passage 202 is closed, or by the abrasion that is generated when the liquid passage 202 is opened and closed, and of microscopic gaps thus being formed. That type of trouble is indicated, for example, in U.S. Publication No. US 2002/0195505.

And, if gaps of this kind are generated, liquid will leak from those gaps. Such leaking liquid can coagulate at the outlet 204, partially blocking the outlet 204, or it will drip, coagulate and then block a portion of the air jetting port 220 as shown in FIG. 16A. This phenomenon readily occurs especially when that liquid is something that disperses microscopic solid particles through the use of a solvent, because those solid particles can easily clump together. If that situation occurs, the direction that the liquid is sprayed, as shown in FIG. 16B, will diverge irregularly on a course that is inclined from the expected and suitable direction of application, and liquid will thus be spray coated in a direction that differs from that originally intended. As a result, for example, when spray coating liquid onto a small target like the target object W, there will be an insufficient amount of liquid that is actually applied onto the coated surface of the target object W.

In addition to the above, the following problems are also generated with a conventional air spray gun. For example, when spray coating liquid onto the small target object W, the appropriate amount of liquid coating is actually only a minute amount. In this case, in order to apply that proper minute amount of liquid, the aperture between the restricting section 208 of the nozzle 200 and the valve portion 212 of the needle valve 210 becomes extremely minute (for example, about 0.06 mm), as shown in FIGS. 14B and 14C.

When spray coating liquid using this kind of minute aperture, it is easy for liquid to clog up such a small opening. If liquid is sprayed when that kind of clogging exists, it will not be possible to spray coat the liquid appropriately onto the target object W. In that case, it is unavoidable to retract the needle valve 210 in order to enlarge the aperture between the restricting section 208 and the valve portion 212 and spray the liquid.

However, in that case, if the liquid is being spray coated onto the target object W at close range, an excessive amount of liquid will be applied to the target object W and, as a result, an uneven coat will be produced, or there will be a problem of the liquid that is applied to the target object W dripping. In order to prevent that, it is necessary to secure a large amount of separation between the air spray gun and the target object W, and thus keep the position from which the liquid is applied onto the target object W at a distance.

In that case, however, the mist flow of the liquid from the air spray gun will be widely dispersed before it reaches the target object W. In other words, the range that the liquid is sprayed in will become unnecessarily large. Due to that, the amount of liquid that passes by the target object W, scatters, and is thus not applied to the target object W, increases. This liquid that disperses and scatters without coming in contact with the target object W thus turns into a loss and results in a large drop in yield. And, that causes an increase in the cost that is required for that liquid.

With the aim of resolving the problem of leakage occurring due to dimensional tolerance, etc., when the valve portion of the needle valve comes in contact with the nozzle's restricting section in the axial direction at the forward end of that needle valve in order to close the liquid passage, US 2002/0195505 indicated an O-ring (78) being retained on the nozzle side and the valve portion of the needle valve coming in contact with that O-ring (78) at the forward end of the needle valve so that, in addition to closing that passage through the contact between the restricting section on the nozzle side and the valve portion of the needle valve, it would also be closed through the contact between that O-ring and the valve portion. In other words, a dual closure mechanism (double seal) is implemented. However, since the valve portion of the needle valve in US 2002/0195505 is in contact with the O-ring (78), when the amount of liquid to be applied is a minute amount, the amount of flexure in the O-ring (78) affects the amount of that coating, so the problem of a drop in precision in the adjustment of the volume of liquid flow is generated when spray coating with a minute amount of liquid.

Although the explanation above used an air spray gun as an example, the same problems are inherent in a hydraulic airless type of spray gun as well.

SUMMARY OF THE INVENTION

The present invention was established in view of the above background, and the problem to be solved is to provide a spray gun that can block the liquid passage effectively without allowing leakage when the liquid passage is closed at the forward end of the needle valve, and that can also adjust the volume of liquid flow with high precision when spraying liquid in minute amounts.

The first mode of the present invention provides a spray gun having a tubular nozzle with an outlet of a liquid in its tip and a needle valve inserted inside the nozzle, the spray gun that atomizes the liquid discharged from the outlet and spray coats the liquid on a target object, including: a fixed-side restricting section provided on an inner circumference of the nozzle; a valve portion provided on a tip of the needle valve as a movable-side restricting section that forms an aperture between the valve portion and the fixed-side restricting section through which the liquid passes and that changes an amount of the liquid that passes through the aperture to reach the outlet by enlarging the aperture along with retracting movement of the needle valve and by narrowing the aperture along with forward movement thereof, the aperture being formed between the fixed-side restricting section and the valve portion in a radial direction by the fixed-side restricting section being situated in a position that is not in contact with the valve portion in an axial direction and that is outward from the valve portion entirely in the radial direction; an elastic seal member that comes in contact and is elastically deformed in the axial direction between the nozzle and the needle valve when the needle valve is moved forward so as to provide a closure section which closes a liquid passage for the liquid that moves toward the outlet upstream of the valve portion; a nozzle hole having the outlet at its tip that is provided on the inner circumference of the tip of the nozzle for inserting the valve portion in the axial direction and whose rear end constitutes the fixed-side restricting section; a female joint that is provided by at least a rear portion of the nozzle hole which includes the fixed-side restricting section and that extends in a straight form in the axial direction over an entire circumference thereof; and a male joint that is provided on a rear portion of the valve portion of the needle valve and extends in a straight form in the axial direction over an entire circumference thereof while fitting into the female joint, the female joint and male joint forming a straight joint, wherein the straight joint is arranged such that, when the needle valve is moved forward, the male joint is inserted into and fits inside the female joint before the elastic seal member comes in contact between the nozzle and the needle valve as well as after the valve portion reaches a position where the aperture between the valve portion and the fixed-side restricting section is a smallest aperture possible, and a state of joint is retained until the elastic seal member comes in contact and is elastically deformed between the nozzle and the needle valve.

A second mode of this invention provides the spray gun according to the first mode, further including a stopper mechanism that, when the needle valve is moved forward, stops the forward movement of the needle valve when the elastic seal member of the closure section comes in contact between the nozzle and the needle valve and is elastically deformed to a set amount of deformation, and that controls displacement of the elastic seal member.

A third mode of this invention provides the spray gun according to the second mode, wherein the stopper mechanism includes: a movable-side contact section that ascends outward in the radial direction at a rear of the male joint of the needle valve; and a fixed-side contact section that is provided on the nozzle in opposition to the movable-side contact section in the axial direction and comes in contact with the movable-side contact section.

A fourth mode of this invention provides the spray gun according to any one of the first to third modes, wherein the elastic seal member is fitted externally onto the needle valve, while a movable-side contact surface and a fixed-side contact surface are provided respectively on an outer peripheral surface of the needle valve and on an inner peripheral surface of the nozzle such that the elastic seal member is sandwiched so as to come in contact and be elastically deformed therebetween in the axial direction.

A fifth mode of this invention provides the spray gun according to any one of the first to fourth modes, wherein the valve portion of the needle valve has a tapered shape that includes a sloped surface on at least one location in a circumferential direction and whose shape causes a distance in the radial direction from the fixed-side restricting section to progressively increase toward a tip of the valve portion, and the aperture overall is formed between the sloped surface and the fixed-side restricting section.

A sixth mode of this invention provides the spray gun according to the fifth mode, wherein the valve portion of the needle valve has an arched cross section, and the sloped surface has a flat face that extends in a chord direction when viewed in the axial direction.

A seventh mode of this invention provides the spray gun according to any one of the first to fourth modes, wherein the valve portion of the needle valve has a groove in at least one location in a circumferential direction whose depth becomes progressively larger toward a tip of the valve portion, and the aperture overall is formed between the groove and the fixed-side restricting section.

As noted above, this invention is provided, upstream of the valve portion, with a closure section that closes the passage for the liquid to move to the outlet through the mechanism of an elastic seal member coming in contact with and being elastically deformed between the nozzle and the needle valve in the axial direction when the needle valve is moved forward.

In other words, rather than blocking and closing the liquid passage by having the valve portion of the needle valve come in direct contact with the opposing side (the nozzle side) like with a conventional spray gun, this invention blocks and closes the liquid passage through the contact and elastic deformation of an elastic seal member that is separated and upstream of the valve portion in the axial direction.

Therefore, with this invention, it is possible to resolve the problems of gaps being created at the forward end of the needle valve between the valve portion and the restricting section due to damage, etc., that occurs to the valve portion and/or the restricting section, and of, in spite of the liquid passage being in a closed state, there being leakage from those gaps, and the liquid outlet and any air jetting port that is provided as necessary being partially blocked due to that leakage.

Incidentally, when adopting an elastic seal member that is situated at a position that is separated and upstream of the valve portion in this way, as explained in the following six paragraphs, a range may be generated wherein the adjustment of the volume of liquid flow is not possible. This happens in the case that, as it is with a conventional spray gun, the adjustment of the amount of liquid is performed using the valve portion and the restricting section and an aperture is created between the male taper-shaped valve portion on the needle valve and the restricting section, which is formed at a portion of the female tapered surface on the nozzle, and when the size of the aperture is enlarged and reduced through the forward and retracting movement of the needle valve.

Namely, when the volume of liquid flow is adjusted by enlarging and reducing the size of the aperture between the restricting section and the valve portion, which are in opposition in the axial direction and radial direction, in accordance with the forward and retracting movement of the needle valve, it is necessary to make that aperture between the valve portion and the restricting section larger than a certain size at the point where the elastic seal member in the closure section comes in contact with and is sandwiched in the axial direction between both opposing contact surfaces.

However, in order to sufficiently seal and close the liquid passage at the closure section, the elastic seal member must not only be in contact with and sandwiched between the contact surfaces, it must also be elastically deformed, and, in order to do so, it is necessary to move the needle valve a designated stroke forward even after the elastic seal member becomes sandwiched between the contact surfaces. On the other hand, at the point that the elastic seal member comes in contact with both contact surfaces, when the aperture between the valve portion and the restricting section is the smallest aperture possible and is not larger than a certain size, the valve portion comes in contact with the restricting section in the axial direction as soon as the needle valve starts to move forward, and that needle valve cannot be moved forward any more than that. Due to that, the elastic seal member cannot be elastically deformed. Therefore, it is necessary to secure an aperture that is larger than a certain size between the valve portion and the restricting section at the point that the elastic seal member comes in contact with both contact surfaces.

However, while larger than that certain size, the aperture between the valve portion and the restricting section cannot be used as the opening for adjusting the volume of liquid flow after the elastic seal member has come in contact with both contact surfaces. That is because, after the elastic seal member comes in contact with both of those contact surfaces, the liquid passage is closed upstream of the valve portion through that contact, in other words, by the closure section. Therefore, even if the aperture between the restricting section and the valve portion is narrowed through the forward movement of the needle valve, it does not adjust the volume of liquid flow, so the range of the forward movement of the needle valve after the elastic seal member comes in contact with both contact surfaces becomes an area where it is not possible to adjust the volume of liquid flow.

The above indicates the case when the needle valve is moved forward, but the situation is the same when the needle valve is retracted. That is, even if the aperture between the restricting section and the valve portion is enlarged along with the retracting movement of the needle valve, as long as the elastic seal member is in contact with both contact surfaces, specifically, up to the time that the shape of the elastic seal member has been restored from a state of elastic deformation and immediately before it disengages from the contact surface, the adjustment of the volume of liquid flow is not accomplished by the movement of the valve portion.

Further, even if the elastic seal member disengages from the contact surfaces, up until the point that the aperture between the elastic seal member and the contact surfaces becomes larger than the aperture between the valve portion and the restricting section, the volume of liquid flow is substantially determined by the aperture between the elastic seal member and the contact surfaces. Therefore, during that period, the adjustment of the volume of liquid flow is not accomplished through a change in the aperture between the valve portion and the restricting section.

This point is the same when the needle valve is moved forward as well; in the range wherein the aperture between the elastic seal member and the contact surfaces becomes smaller than the aperture between the valve portion and the restricting section, the adjustment of the volume of liquid flow is not accomplished by the aperture between the valve portion and the restricting section. The problem above is caused by the enlargement and reduction in the size of that aperture in accordance with the valve portion coming in contact with and disengaging from the restricting section in the axial direction so as to open and close that aperture between the restricting section and the valve portion.

In view of the situation described in the seven paragraphs above, this invention was given a structure wherein the restricting section does not contact the valve portion in the axial direction. In other words, the restricting section is positioned in the state where it is situated outward in the radial direction in relation to the valve portion overall, and the aperture is formed in a radial direction to the restricting section and the valve portion. That way, because the valve portion is given a structure wherein it can be inserted into the restricting section at any point along its length, the valve portion and the restricting section mutually avoid coming in direct contact due to their relative displacement in the axial direction.

This aperture in the radial direction between the restricting section and the valve portion can be produced, for example, by giving at least a portion of the valve portion in the circumferential direction a tapered shape toward its tip. That radial aperture is then enlarged along with the retracting movement of the needle valve and narrowed along with its forward movement. If accomplished in this way, even if the elastic seal member comes in contact with both contact surfaces at a position where the smallest aperture possible is formed between the valve portion the restricting section in the radial direction, it is then possible to move the needle valve forward and it is possible to elastically deform the elastic seal member between the contact surfaces through the forward movement of that needle valve.

However, with this alone, it is still not possible to eliminate the range wherein it is not possible to adjust the volume of liquid flow using the valve portion and the restricting section. In order to make it possible to adjust the volume of liquid flow with the valve portion and the restricting section over the entire range, from the position where the largest aperture is formed between the valve portion and the restricting section to the position where the smallest aperture possible is formed, the elastic seal member is made to come in contact with both contact surfaces only after the valve portion already reaches the position where the smallest aperture possible is formed between the valve portion and the restricting section. It is also necessary that substantially no aperture be produced in the radial direction inward from the restricting section after the valve portion reaches the position where the smallest aperture possible is formed between the valve portion and that restricting section up until the elastic seal member is made to come in contact with both contact surfaces and then is also elastically deformed.

Here, with this invention, the fixed-side restricting section is formed at a point at the rear portion of the nozzle hole that is provided on the inner circumference of the nozzle tip. And, while at least the rear portion of the nozzle hole, including that restricting section, is used as a female joint that extends in a straight form in the axial direction, a male joint that also extends in a straight form in the axial direction in that same way and that then fits into that female joint is provided on the rear portion of the valve portion of the needle valve. A straight joint is thus formed through that female joint and male joint. Then, when the needle valve is moved forward, before the elastic seal member comes in contact with both contact surfaces, and, moreover, after the valve portion reaches the position where the aperture between the valve portion and the restricting section is the smallest aperture possible, the male joint is inserted and fits into the female joint, and this state of joint forming that straight joint is retained until the elastic seal member comes in contact with both contact surfaces and is elastically deformed.

That way, with this invention, by connecting the female joint and the male joint, it is possible to make the aperture between them substantially zero. That is, it is possible to make the aperture in the radial direction inward from the restricting section substantially zero. And thus, the connection between that female joint and male joint is retained, both after the valve portion reaches the position where the aperture between the valve portion and the restricting section is the smallest aperture possible and up until the elastic seal member comes in contact with both contact surfaces and is elastically deformed.

Namely, with this invention, when the needle valve is moved forward, after the valve portion reaches the position where the aperture between the valve portion and the restricting section is the smallest aperture possible, it is possible to secure an aperture inside the restricting section that is virtually zero using the connection of the female joint and the male joint. After that, because the elastic seal member comes in contact with both contact surfaces in the axial direction and is also sandwiched between them and elastic deformed in the axial direction, it is possible to adjust the volume of liquid flow effectively and without difficulty by enlarging and reducing the size of that aperture, over the entire range, from the position where the largest aperture is formed between the valve portion and the restricting section to the position where the smallest aperture possible is formed. It is also possible to block and close the liquid passage effectively in a sealed state using the contact of the elastic seal member with both contact surfaces and its subsequent elastic deformation.

Therefore, with this invention, it is possible to prevent leaks at the forward end of the needle valve and to close the liquid passage effectively, and it is possible to prevent liquid, despite the liquid passage being closed, from leaking due to microscopic gaps generated in the needle valve between the valve portion and the restricting section. Through this, it is possible to resolve the problem of becoming unable to spray coat effectively due to the coagulation of leaking liquid. It is also possible to use the valve portion and the restricting section to adjust and control, with high precision, the amount of liquid that passes through the liquid passage to the outlet.

With this invention, it is also possible to give the nozzle hole a tapered inner peripheral surface, etc., toward its outlet, and, more ideally, it is possible to form that nozzle hole with a straight form in the axial direction over its entire circumference up to the outlet.

Meanwhile, the spray gun constructed in accordance with the second mode of this invention further includes a stopper mechanism that, when the needle valve is moved forward, stops the forward movement of the needle valve when the elastic seal member of the closure section comes in contact between the nozzle and the needle valve and is elastically deformed to a set amount of deformation, and that controls displacement of the elastic seal member. Therefore, it is possible to prevent excessive deformation of the elastic seal member and enhance the durability of that elastic seal member.

The third mode of this invention provides the spray gun according to the second mode, wherein the stopper mechanism includes: a movable-side contact section that ascends outward in the radial direction at a rear of the male joint of the needle valve; and a fixed-side contact section that is provided on the nozzle in opposition to the movable-side contact section in the axial direction and comes in contact with the movable-side contact section. Therefore, it is possible to securely limit the moving edge of the needle valve toward the front of the nozzle and, for example, prevent excessive elastic deformation, etc., of the elastic seal member. Thus, the elastic seal member is able to come in solid contact with the contact surfaces of both the movable-side contact section and the fixed-side contact section, and be elastically deformed into a state of compression.

Here, when the elastic seal member is provided on the needle valve side, it is possible to situate the movable-side contact section to the rear of the elastic seal member, but it is preferable that it be provided in front of that elastic seal member.

The fourth mode of this invention provides the spray gun according to any one of the above-mentioned first to third modes, wherein the elastic seal member is fitted externally onto the needle valve, while a movable-side contact surface and a fixed-side contact surface are provided respectively on an outer peripheral surface of the needle valve and on an inner peripheral surface of the nozzle such that the elastic seal member is sandwiched so as to come in contact and be elastically deformed therebetween in the axial direction. Therefore, it is possible to stably retain the elastic seal member, which is situated between those opposing surfaces of the movable-side contact surface and the fixed-side contact surface, in an externally fitted state on the needle valve. By positioning the elastic seal member with high precision in the radial direction and in secure contact with both contact surfaces, namely, the movable-side contact surface and the fixed-side contact surface, it is also possible to the securely sandwich and elastically deform the elastic seal member when the needle valve is moved forward.

The fifth mode of this invention provides the spray gun according to any one of the above-mentioned first to fourth modes, wherein the valve portion of the needle valve has a tapered shape that includes a flat sloped surface on at least one location in a circumferential direction and whose shape causes a distance in the radial direction from the fixed-side restricting section to progressively increase toward a tip of the valve portion and spans from widthwise one end to the other of the valve portion when viewed in the axial direction, and the aperture overall is formed between the sloped surface and the fixed-side restricting section. Therefore, it is possible to secure a larger size for that aperture in the radial direction in relation to the total area of the opening where the paint is discharged.

Namely, in the case of the conventional spray gun shown in FIGS. 14A to 14C, a circular aperture that extends with a substantially regular size over the entire circumference is produced between the male tapered valve portion 212 of the needle valve 210 and the female tapered surface 206 of the nozzle 200, specifically the restricting section 208. Thus, even if a certain amount of total area (the total area of its transverse cross section) is acquired for the aperture that determines the amount of liquid that is discharged, the size of the aperture in the radial direction between the valve portion 212 and the restricting section 208 will be small.

Nevertheless, with this mode, because the aperture between the valve portion and the restricting section is formed with a limit of one, two or several locations in the circumferential direction, with the total area of the aperture made the same as that of the conventional spray gun shown in FIGS. 14A to 14C, it is possible to increase the size of the aperture itself in the radial direction. Ideally, that number of openings on the circumference of the valve portion is made only one location, and by doing so, it is possible to further increase the size of the aperture itself in the radial direction in relation to the total area of the opening.

By thus making the aperture larger, it becomes difficult for liquid to clog in that opening, and it is therefore possible to resolve the conventional problem of being unable to spray coat liquids effectively due to liquid clogging in the opening. And, when the size of the aperture is made the same as that of the conventional spray gun shown in FIGS. 14A to 14C, it is possible to make the total area of the opening smaller. And due to that, it is possible to reduce the amount of liquid that is discharged (the amount sprayed).

Therefore, for example, when spray coating liquid onto a small target object, it becomes possible to bring the position of the spray gun closer to the target object than was conventionally possible, and to spray coat that liquid onto the target object from point-blank range. In that case, it is possible to reduce the dispersion of the mist flow up until the sprayed liquid reaches the target object and it is thus possible to more effectively spray coat the liquid onto that target object. And, because liquid scatter can also be minimized as much as possible and liquid loss can thus be minimized, the yield rate can be improved and the cost that is required for the liquid can be reduced.

The sixth mode of this invention provides the spray gun according to the above-mentioned fifth mode, wherein the valve portion of the needle valve has an arched cross section, and the sloped surface has a flat face that extends in a chord direction when viewed in the axial direction. Therefore, it is possible to more easily process and manufacture the valve portion of the needle valve in comparison with when adopting, for example, a sloped surface that is curved or bent. The shape of the opening that discharges the paint can also be simplified and the liquid prevented from clogging the opening.

The seventh mode of this invention provides the spray gun according to any one of the above-mentioned first to fourth modes, wherein the valve portion of the needle valve has a groove in at least one location in a circumferential direction whose depth becomes progressively larger toward a tip of the valve portion, and the aperture overall is formed between the groove and the fixed-side restricting section. Therefore, it is possible to more effectively increase the size of the aperture in the radial direction when the total area of the opening at the liquid outlet is uniform. In that case, it is possible to form the groove in the valve portion with a variety of shapes, such as those having V-shape or U-shape in the transverse cross section, or other concave shape.

With this mode, it is possible, for example, to shape the groove so that its width gradually becomes progressively wider toward the tip. Furthermore, ideally, the number of grooves on the circumference of the valve portion is made only one location, and by doing so, it is possible to further increase the size of the aperture itself in the radial direction (the size of the groove depth) in relation to the total area of the opening.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein:

FIGS. 6A and 6B are views suitable for explaining the aperture S1 in the first embodiment in comparison with that in an air spray gun of Comparative Example, wherein FIG. 6A indicates Comparative Example and FIG. 6B indicates the present embodiment;

FIGS. 10A and 10B are views showing a principle part of an air spray gun as another embodiment of the present invention, wherein FIG. 10A is a longitudinal cross-section view and FIG. 10B is a perspective view of a needle valve of the air spray gun shown in FIG. 10A;

FIGS. 12A and 12B are views showing a principle part of an air spray gun as still yet another embodiment of the present invention, wherein FIG. 12A is a longitudinal cross-section view and FIG. 12B is a perspective view of a needle valve of the air spray gun shown in FIG. 12A;

FIGS. 13A and 13B are views showing a principle part of an air spray gun as a further embodiment of the present invention, wherein FIG. 13A is a longitudinal cross-section view and FIG. 13B is a perspective view of a needle valve of the air spray gun shown in FIG. 13A;

DETAILED DESCRIPTION OF PREFERRED EMBODIMENTS

The following describes embodiments of this invention that are applied to an air spray gun that spray coats liquid with reference to the drawings.

Figure 1:
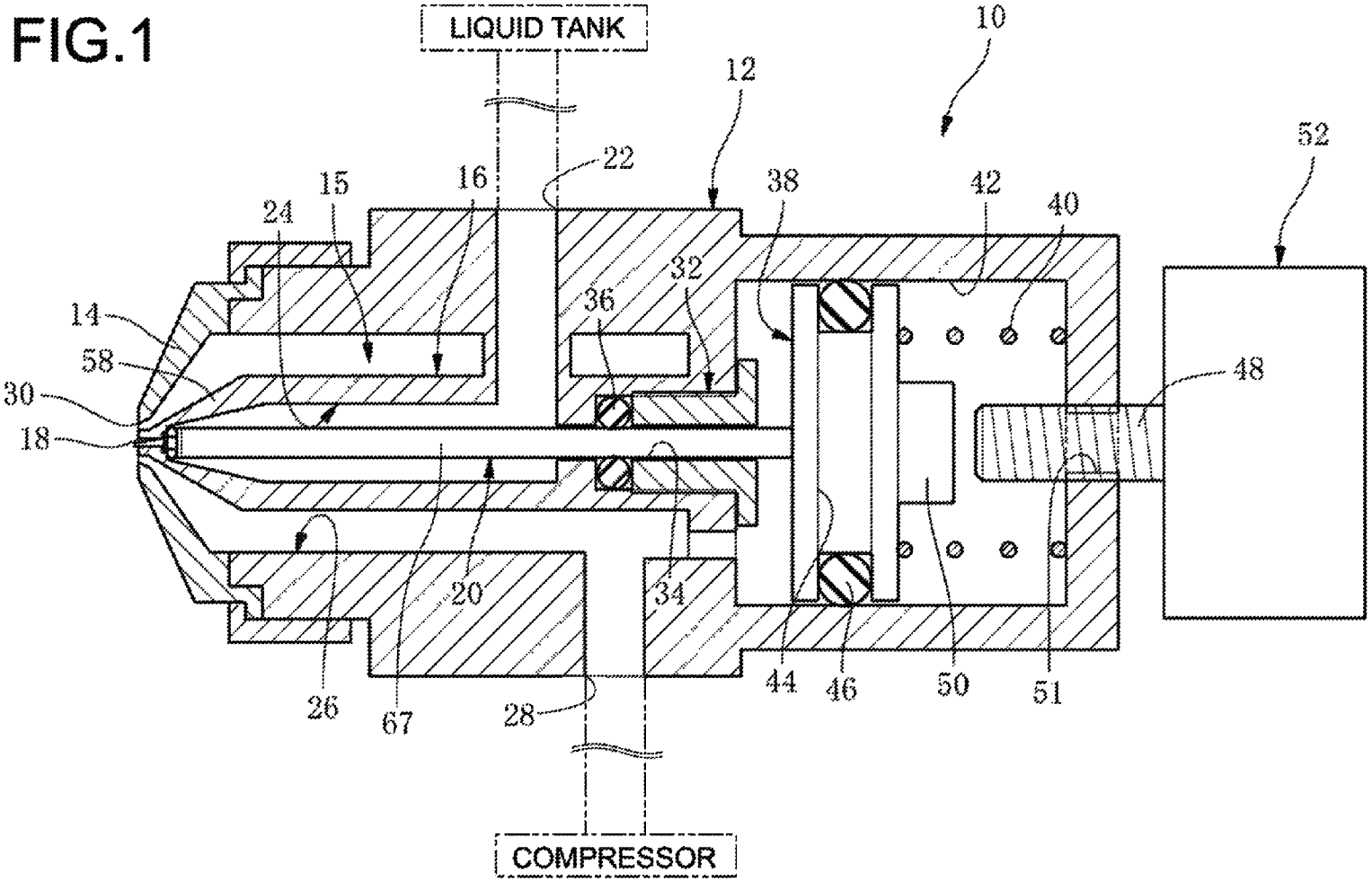
FIG. 1 is a longitudinal cross-section view of an air spray gun as a first embodiment of the present invention.

FIG. 1 shows an air spray gun (hereinafter referred as simply "spray gun") 10 as the first embodiment of this invention. More specifically, the spray gun 10 is constructed with a cap 14 attached to the tip of a main body 12.

Figure 2A:
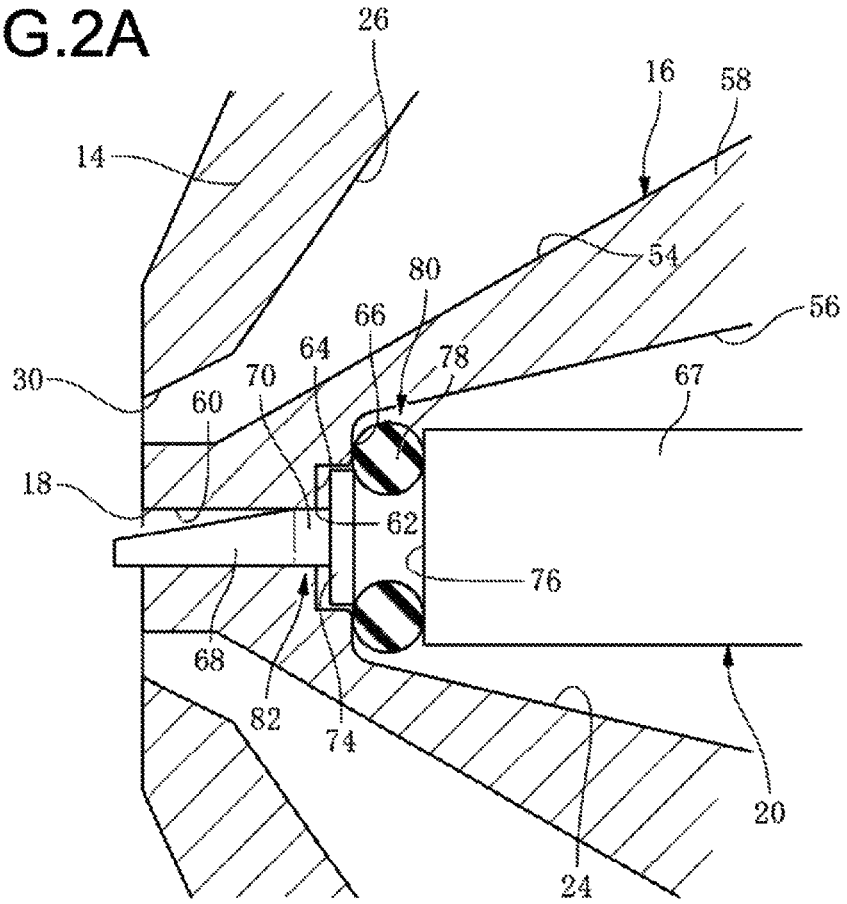
FIG. 2A is an enlarged view of a principle part of the air spray gun shown in FIG. 1.
Figure 2B:
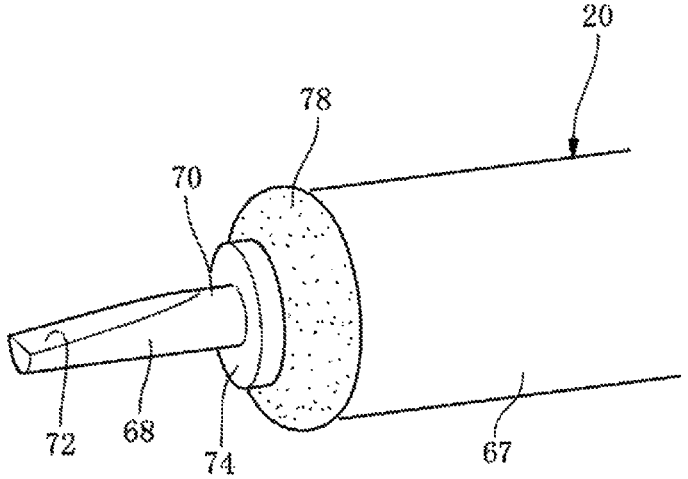
FIG. 2B is an enlarged perspective view of a principle part of a needle valve of the air spray gun shown in FIG. 1.

FIG. 2A shows a tubular nozzle 16 that comprises the main structural component of a needle valve mechanism 15. A needle valve 20 (see FIG. 2B) is given a narrow shaft shape (needle shape) and is inserted inside this nozzle 16. A liquid passage 24, which dispenses the liquid that is supplied from a liquid tank, etc., is formed between the nozzle 16 and the needle valve 20. One end of the liquid passage 24 opens onto the outer peripheral surface of the main body 12 through a liquid supply port 22, while the other end opens onto the outside at the tip of the main body 12. Through this, the liquid that was dispensed through the liquid passage 24 is discharged to the outside from an outlet 18 at the tip of the liquid passage 24. The needle valve mechanism 15 is comprised of the nozzle 16, the needle valve 20, and the various functional parts that they are equipped with.

On the other hand, an air passage 26 that dispenses the air that is supplied from an air supply port 28 is formed in the outer circumference of the nozzle 16. The air supply port 28 opens onto the peripheral surface of the main body 12 and connects to the air passage 26. The air that is dispensed through the air passage 26 is, as shown in FIG. 2A, discharged to the outside from an air jetting port 30 that is formed between the tip of the cap 14 and the tip of the nozzle 16.

With the spray gun 10 in this embodiment, the air that is compressed with a compressor is discharged from the air jetting port 30, to the left in FIG. 1, and liquid is drawn out of the outlet 18 by the negative pressure that is generated by that air spray. In other words, liquid is discharged from the outlet 18. And, by having the compressed air that is sprayed from the air jetting port 30 collide with that discharged liquid, the liquid is atomized into a mist and, through that, it can ride the air jet stream and be spray coated onto the target object.

Furthermore, a guide member 32 is attached to the main body 12. This guide member 32 guides the movement of the needle valve 20 and is given an overall cylindrical shape. And, with the needle valve 20 inserted into a center guide hole 34, the guide member 32 is attached to the main body 12 by a thread connection. Specifically, a male screw is provided on the outer peripheral surface of this guide member 32, and that male screw is connected by being threaded into a female screw that is provided on the main body 12.

An O-ring 36 is installed at the front of the guide member 32 (to the left in FIG. 1), between the guide member 32 and the main body 12. By elastically compressing this O-ring 36 with the guide member 32, the space between the outer peripheral surface of the needle valve 20 and the main body 12 can be sealed airtight. Through that seal with the O-ring 36, the liquid in the liquid passage 24 is prevented from leaking to the rear (to the right in FIG. 1).

In addition, a large diameter piston 38 is provided at the rear end of the needle valve 20, and, together with a compression coil spring 40 of metal that presses both the piston 38 and the needle valve 20 toward the front, the piston 38 is housed inside a housing chamber 42 that is provided toward the rear of the main body 12. Further, an annular O-ring groove 44 that extends in the circumferential direction is provided on the outer peripheral surface of this piston 38, an elastic O-ring 46 is retained inside this O-ring groove 44, and an airtight seal is created between the outer circumference of the piston 38 and the walls of the housing chamber 42 by the O-ring 46.

A stopper 48 is also provided to the rear of the piston 38, and the amount that the piston 38 is retracted, in other words, the amount that the needle valve 20 is open when opened fully, is controlled through contact with a contact portion 50 that is provided on the rear end surface of the piston 38. Here, the stopper 48 is comprised of a male screw member, the stopper 48 is screwed into a female screw hole 51 that penetrates through the wall of the housing chamber 42, and it is possible to adjust the amount that the valve is open when the needle valve 20 is opened fully by adjusting how far the stopper 48 is screwed in.

An adjustment controller 52 is then provided at the rear end of the stopper 48.This adjustment controller 52 is fixed to the rear end of the stopper 48, which is comprised of a male screw member, by means of adhesive or welding, etc., and these parts rotate integrally to provide a dial-type of adjustment for the stopper position using the stopper 48. By rotating the adjustment controller 52, the stopper 48 is moved forward and back in the wall of the housing chamber 42 and, through that, the stopper position for the retraction of the piston 38 is adjusted in the forward-retracting direction (left-right in FIG. 1). In other words, it adjusts the amount that the needle valve 20 is open when it is opened fully.

With the spray gun 10 in this embodiment, first of all, liquid is supplied from the liquid tank, through the liquid supply port 22, to the inside of the liquid passage 24. Then, once compressed air from the compressor is supplied through the air supply port 28 to the inside of the air passage 26, the piston 38 is retracted by that compressed air all the way to the right in FIG. 1, that is, up to the position at which the contact portion 50 comes in contact with the preset stopper 48. There, at the same time as the piston 38 and the needle valve 20 retract the designated amount, the outlet 18 that is shown in FIG. 2A is opened the designated amount. And, at the same time as air is supplied to the spray gun 10, liquid is discharged from the outlet 18 of the liquid passage 24. At that time, by discharging air from the air jetting port 30, the liquid is atomized and sprayed. Conversely, by stopping the supply of air, the piston 38 and the needle valve 20 are pushed and moved forward by the metallic compression coil spring 40, and the outlet 18 and the liquid passage 24 are closed. This way, the spray from the spray gun 10 is stopped.

As shown in FIG. 2A, a tapered portion 58 is provided on the tip portion of the nozzle 16 with its outer peripheral surface given as a male tapered surface 54 and its inner peripheral surface given as a female tapered surface 56. Further, a nozzle hole 60 is provided even more toward the tip than this tapered portion 58, with its cross section (transverse cross section) being circular and extending in a straight form with substantially the same diameter in the axial direction (the direction that the center axis line of the nozzle 16 extends) over its entire circumference. The outlet 18 is formed on the tip of this nozzle hole 60, and a valve portion 68 (described later) is inserted into the nozzle hole 60 in the axial direction. And, the rear end (the right end in FIG. 2A) of this nozzle hole 60 constitutes a fixed-side restricting section 62 that forms an aperture between the nozzle hole 60 and the valve portion 68 of the needle valve 20 in order to adjust the volume of liquid flow. Here, the nozzle hole 60 overall constitutes the female joint of a straight joint 82 (described later).

Figure 3A:
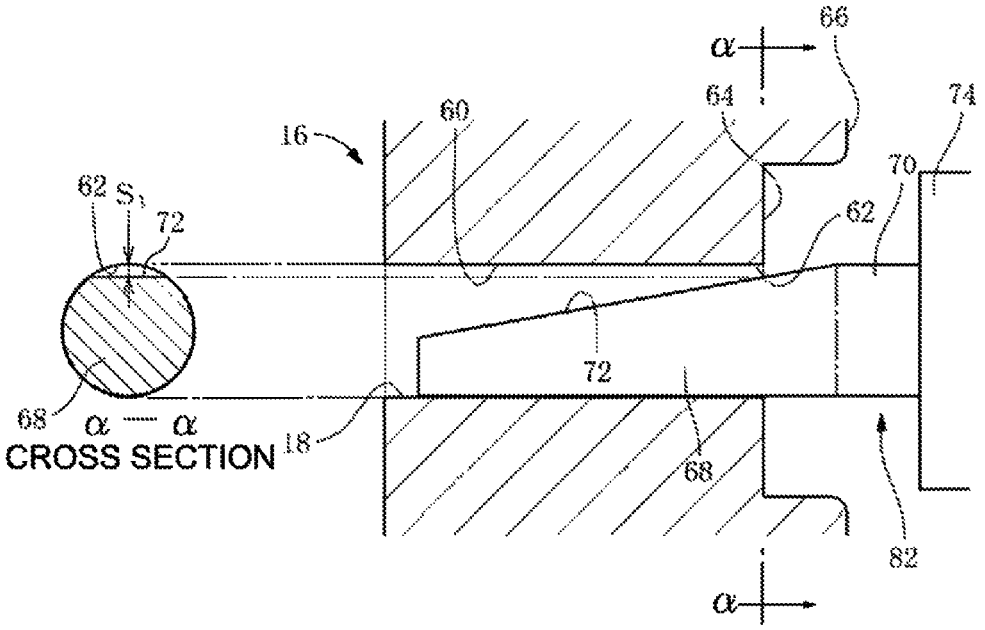
FIGS. 3A and 3B are views suitable for explaining the changes in aperture S1 in the first embodiment when the needle valve moves, wherein FIG. 3A indicates the state where the needle valve has been moved to the rear from its state in FIG. 2A, and FIG. 3B indicates the state where the needle valve is moved even farther to the rear from its state in FIG. 3A.
Figure 3B:
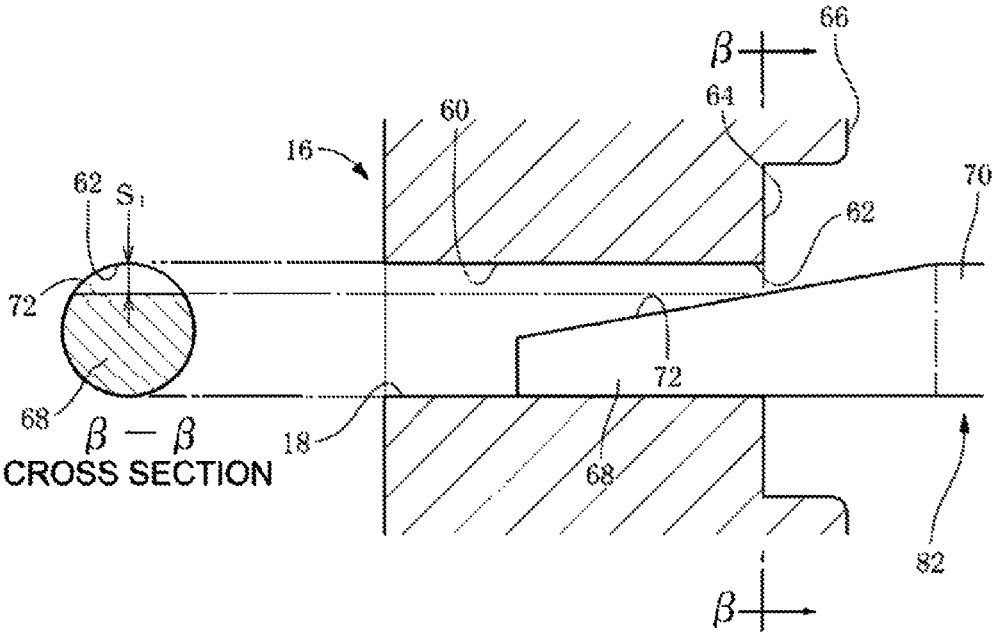

As also shown in FIGS. 3A and 3B, a fixed-side contact section 64 is provided on the nozzle 16 and ascends at a right angle (in the direction orthogonal to the center axis line of the nozzle 16) and outward in the radial direction from the rear end of the nozzle hole 60. Further, a contact surface 66 that comes in contact with the O-ring 78 (described later) is provided at a position even further to the rear (to the right in FIGS. 3A and 3B) from this fixed-side contact section 64, and with a shape that also ascends at a right angle in the radial direction. The functions of the fixed-side contact section 64 and the contact surface 66 are described later.

The needle valve 20 includes the valve portion 68 at the tip of a needle body 67 of narrow shaft shape, and a male joint 70 having a circular cross section and extending in a straight form in the axial direction over its entire circumference is provided between the needle body 67 and the valve portion 68. With this embodiment, at one location in the circumferential direction, specifically at one location at the top in FIGS. 3A and 3B, the valve portion 68 is provided with a flat sloped surface 72 that transitions progressively downward, as shown in FIGS. 3A and 3B, toward the tip. In this embodiment, this sloped surface 72 causes the distance between the valve portion 68 and the restricting section 62 in the radial direction to progressively increase. Thus, the valve portion 68 in this embodiment is given a tapered shape that becomes progressively thinner toward the tip. The restricting section 62 is formed at a position that is not in contact with the valve portion 68 in the axial direction and that is outward from the valve portion in the radial direction.

Here, as shown in the left side of FIGS. 3A and 3B, the sloped surface 72 is provided from one end in the width direction of the valve portion 68 to the other end when viewed in the axial direction. The cross section of the valve portion 68 is given an arched shape and the sloped surface 72 has a flat face that extends in the chord direction when viewed in the axial direction. Through this, when the valve portion 68 inserted into the nozzle hole 60, an approximately crescent to half-moon shaped aperture S1 is produced between the valve portion 68 and the restricting section 62 in the radial direction. And the liquid that is inside the liquid passage 24 can be sprayed to the outside through this aperture that is formed between the valve portion 68 and the restricting section 62. With this embodiment, that aperture overall is formed between the sloped surface 72 and the restricting section 62, and the surface of the tip of the valve portion 68 is given a vertically flat face in the axial direction. Except for its sloped surface 72 portion, the valve portion 68 is in a state of joint with the inner peripheral surface of the nozzle hole 60 when inserted into the nozzle hole 60.

The male joint 70 is inserted inside the female joint that is formed by the nozzle hole 60, and as the part that fits into the female joint, the outside diameter of this male joint 70 is made substantially the same diameter as that female joint, in other words the inner diameter of the nozzle hole 60, and thus forms a component wherein there is substantially no gap between the male joint 70 and the nozzle hole 60, specifically between the male joint 70 and the restricting section 62.

A movable-side contact section 74, which ascends at a right angle and outward in the radial direction, is provided on the needle valve 20, at a position to the rear of the valve portion 68 and the male joint 70 (to the right in FIG. 2A). Further, an O-ring groove 76 is provided on the rear side of this movable-side contact section 74 and an O-ring 78 is retained there as an elastic seal member. On the outer peripheral surface of the needle valve 20, a circumferential wall surface (the surface from which the leader line indicated by number 76 is drawn in FIG. 2A) at the rear side of the O-ring groove 76 in the axial direction of the needle valve 20 serves as a movable-side contact surface that is positioned in opposition in the axial direction to the fixed-side contact surface 66 that is provided on the inner peripheral surface of the nozzle 16. The O-ring 78 is retained in an externally fitted state onto the needle valve 20 between the fixed-side contact surface 66 and the movable-side contact surface (one side of the wall surface of the O-ring groove 76) and, as described later, when the needle valve 20 is moved forward but before the fixed-side and movable-side contact sections, 64 and 74, come in contact, the O-ring 78 comes in contact with both the fixed-side contact surface 66 and the movable-side contact surface, then is sandwiched in the axial direction, and is compressed and elastically deformed by both contact surfaces.

This O-ring 78 cooperates with the contact surface 66 on the nozzle 16 to form a closure section 80 that closes the liquid passage 24 upstream of the valve portion 68 and the male joint 70 (on the right side in FIG. 2A). In other words, by the O-ring 78 coming in contact with the contact surface 66 and being elastically deformed when the needle valve 20 is moved forward, the liquid passage 24 is blocked and closed into a sealed state. The male joint 70 constitutes the straight joint 82 together with the female joint that is formed by the nozzle hole 60.

With this embodiment, when the needle valve 20 is moved forward, the male joint 70 is inserted into and fits inside the nozzle hole 60, which forms the female joint, after the valve portion 68 reaches the position where aperture S1, which is produced between the valve portion 68 and the restricting section 62, is the smallest aperture possible, specifically after the right side of the sloped surface 72 in FIG. 2A reaches the position where it opposes the restricting section 62 in the radial direction, as well as before the O-ring 78 on the needle valve 20 side comes in contact with the contact surface 66 of the nozzle 16. That state of joint between the male and female joints is retained until the O-ring 78 comes in contact with the contact surface 66, then is elastically deformed, and reaches the designated amount of deformation. The designated amount of deformation at that time may be the set amount of elastic deformation described later, or may be smaller than that set amount. The positions and shapes of the valve portion 68, the male joint 70, the nozzle hole 60 which constitutes the female joint, the O-ring 78 and the contact surface 66 are determined as stated above in advance. When the O-ring 78 is elastically deformed and the amount of that deformation reaches the amount of elastic deformation that is set in advance, the movable-side contact section 74 of the needle valve 20 comes in contact with the fixed-side contact section 64 on the nozzle 16 in the axial direction, and there, further forward movement of the needle valve 20 is stopped through a stopper effect. In other words, with this embodiment, a stopper mechanism that stops the forward movement of the needle valve 20 and also controls any further displacement of the O-ring 78 is formed by the movable-side contact section 74 and the fixed-side contact section 64 provided in opposition to the movable-side contact section 74 in the axial direction.

With this embodiment, as shown in FIGS. 3A and 3B, the aperture S1 in the radial direction between the valve portion 68 and the restricting section 62 is enlarged and narrowed by the forward and retracting movement of the valve portion 68 in the left and right direction below the restricting section 62 in FIGS. 3A and 3B, in accordance with the forward and retracting movement of the needle valve 20. Specifically, aperture S1 is enlarged along with the retracting movement of the needle valve 20 and aperture S1 is narrowed along with the forward movement of the needle valve 20. That is, the valve portion 68, at the tip of the needle valve 20, functions as the movable-side restricting section. By so doing, the amount of liquid that flows through aperture S1 to the outlet 18 is increased and reduced and can be adjusted.

Figure 4A:
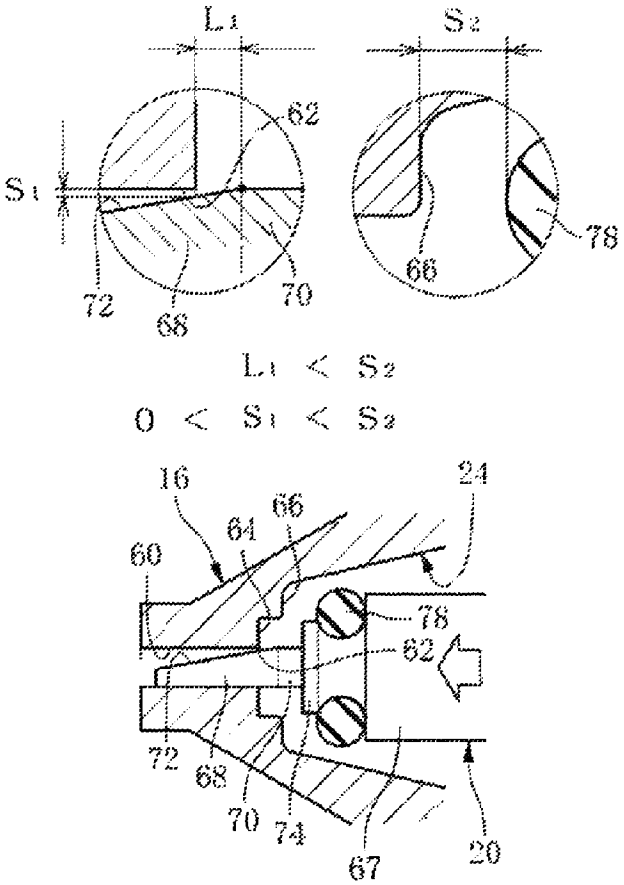
FIGS. 4A and 4B are views suitable for explaining the action of the air spray gun in the first embodiment when the needle valve is moved forward, wherein FIG. 4A indicates the state where a rear end of a valve portion is positioned to the rear of a restricting section, and FIG. 4B indicates, in continuation of FIG. 4A, the state where an aperture S1 between the valve portion and the restricting section is the smallest aperture possible.
Figure 4B:
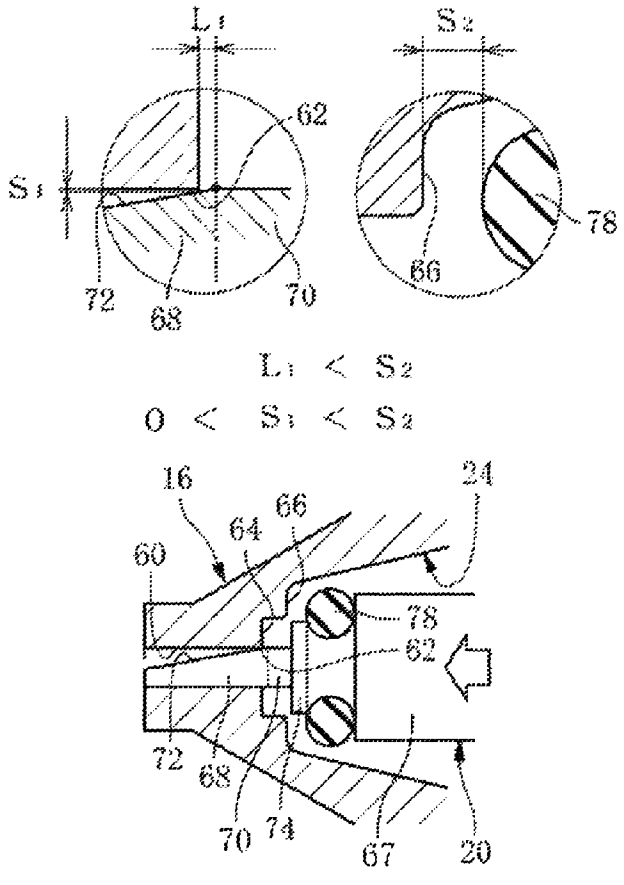

FIG. 4A shows the state of the rear end of the valve portion 68, that is, the rear end of the sloped surface 72 positioned to the rear of the restricting section 62 (to the right in FIGS. 4A and 4B). From this state, if the valve portion 68 is moved forward, to the left in FIGS. 4A and 4B, along with the forward movement of the needle valve 20, as shown in FIG. 4B, at a certain point, the rear end of the valve portion 68 (the rear end of the sloped surface 72) reaches its closest position to the restricting section 62, and the valve portion forms the smallest aperture possible for aperture S1 between the valve portion 68 and the restricting section. And the smallest aperture possible is made slightly larger than zero.

At that time, distance L1 between the front end of the male joint 70 of the needle valve 20 and the restricting section 62 is smaller in comparison with the situation shown in FIG. 4A. Aperture S2 between the O-ring 78, which is retained in the needle valve 20, and the contact surface 66 of the nozzle 16 is also smaller in comparison with the situation shown in FIG. 4A. Further, in the situation shown in FIG. 4B, aperture S2 between the O-ring 78 and the contact surface 66 is larger than distance L1 between the front edge of the male joint 70 and the restricting section 62.

Figure 5A:
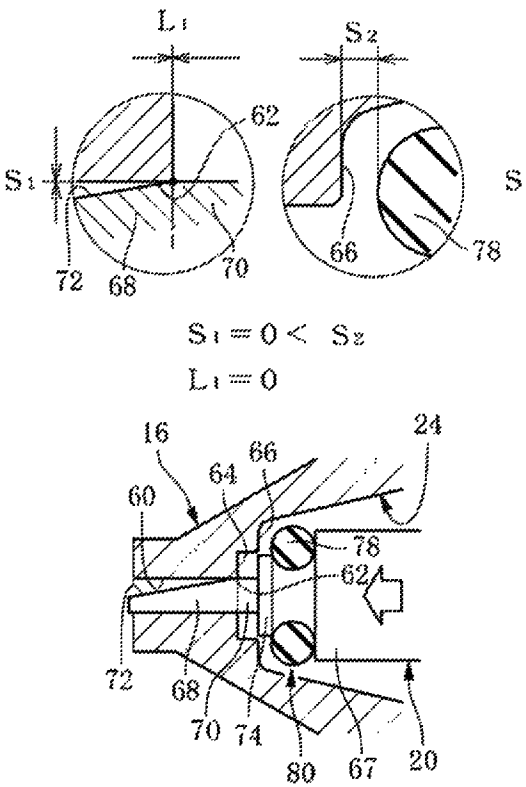
FIGS. 5A-5C are views suitable for explaining the action of the air spray gun in the first embodiment in continuation of FIG. 4B, wherein FIG. 5A indicates the state where the rear end of the valve portion has passed by a rear edge of the restricting section, FIG. 5B indicates, in continuation of FIG. 5A, the state where an O-ring of the needle valve is in contact with a contact surface, and FIG. 5C indicates, in continuation of FIG. 5B, the state where the O-ring of the needle valve is elastically deformed and a liquid passage is sealed.

After that, if the valve portion 68 is moved further forward, as shown in FIG. 5A, the rear end of the valve portion 68 passes by the restricting section 62. Immediately after that, the male joint 70 is in a state of joint inside the rear end of the female joint that is formed by the nozzle hole 60. Even at this point, aperture S2 is produced between the O-ring 78 and the contact surface 66. In other words, the male joint 70 fits into the female joint before the O-ring 78 comes in contact with the contact surface 66. And, once the male joint 70 fits into the female joint that is formed by the nozzle hole 60, aperture S1 on the inside in the radial direction of the restricting section 62 is substantially in a state of zero.

Figure 5B:
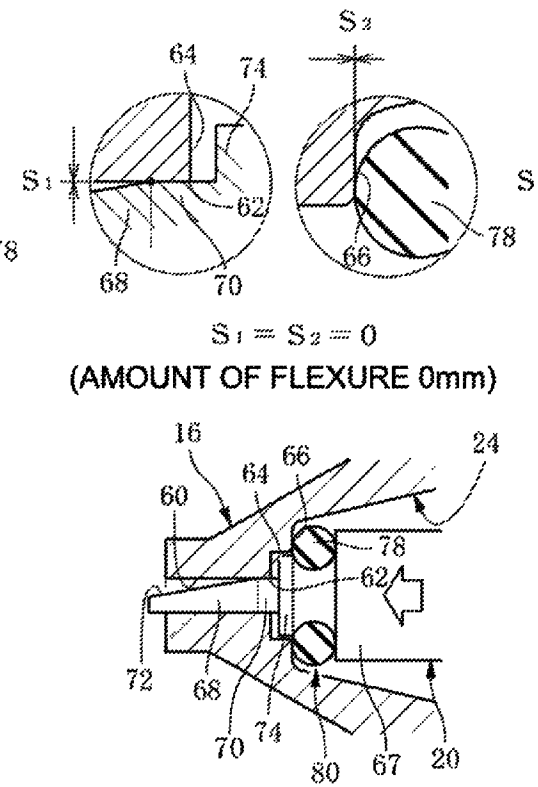

In short, with aperture S2 produced between the O-ring 78 and the contact surface 66, by first of all the male joint 70 and female joint being fit together, aperture S1 on the inside of the restricting section 62 in the radial direction is substantially eliminated. And, through the further forward movement of the valve portion 68, as shown in FIG. 5B, the O-ring 78 comes in contact with the contact surface 66. Therefore, at this point, aperture S2 between the O-ring 78 and the contact surface 66 becomes zero. However, at that point, there still cannot be said to be a sufficient seal between the O-ring 78 and the contact surface 66. If the valve portion 68 is moved further forward after that, the O-ring 78 is elastically deformed in accordance with that movement and its adhesion with the contact surface 66 is heightened. The joint between the male joint 70 and the female joint that is formed by the nozzle hole 60 is retained even during this time, and the aperture inside of the restricting section 62 in the radial direction is still maintained substantially in a state of zero.

Figure 5C:
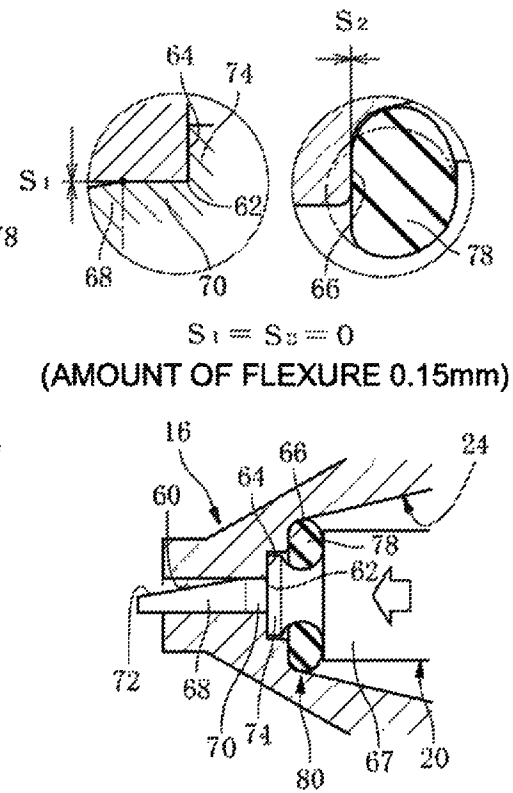

And, as shown in FIG. 5C, by the valve portion 68 being moved further forward, the O-ring 78 is elastically deformed to the amount of deformation that is set in advance. With this embodiment, when the O-ring 78 is elastically deformed to the set amount of deformation, for example, up to when the amount of flexure is 0.15 mm as the left-right direction in FIG. 5C, the movable-side contact section 74 on the needle valve 20 comes in contact with the fixed-side contact section 64 of the nozzle 16 in the axial direction, and there, the forward movement of the needle valve 20, i.e., the valve portion 68, is stopped. And, at that point, the liquid passage 24 is closed with a sufficient seal between the O-ring 78 and the contact surface 66 upstream at a different position than the valve portion 68.

Above is the action in the case of the forward movement of the needle valve 20, and that action is opposite in the case of the retracting movement of the needle valve 20.

Figure 14A:
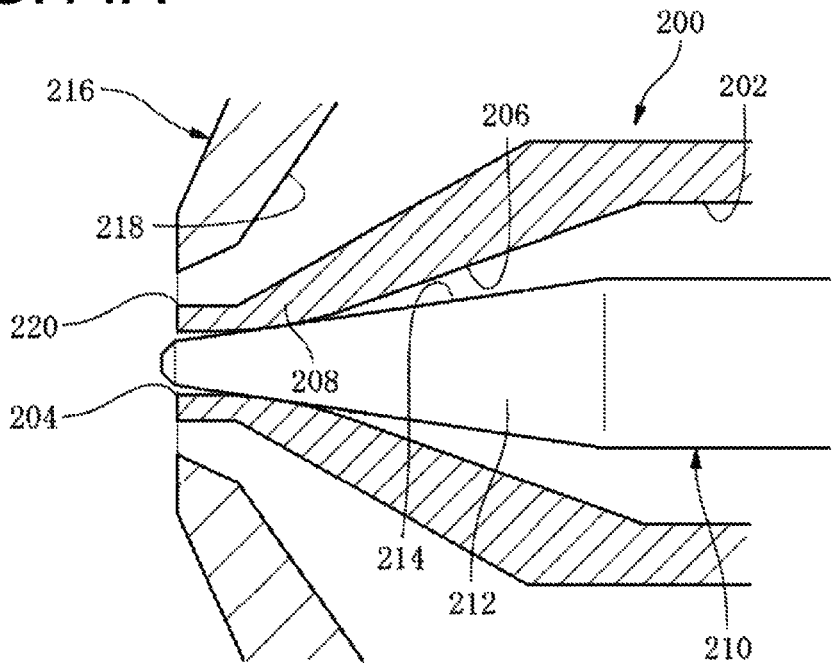
FIG. 14A is a longitudinal cross-section view showing a principle part of a conventional air spray gun.
Figure 14B:
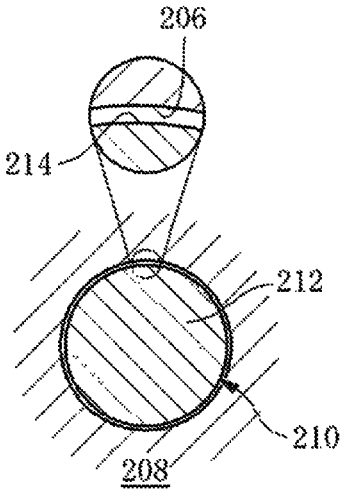
FIG. 14B is a transverse cross-section view showing the principle part as well as a partial cross-section view taken along line 14B-14B of FIG. 14C.
Figure 14C:
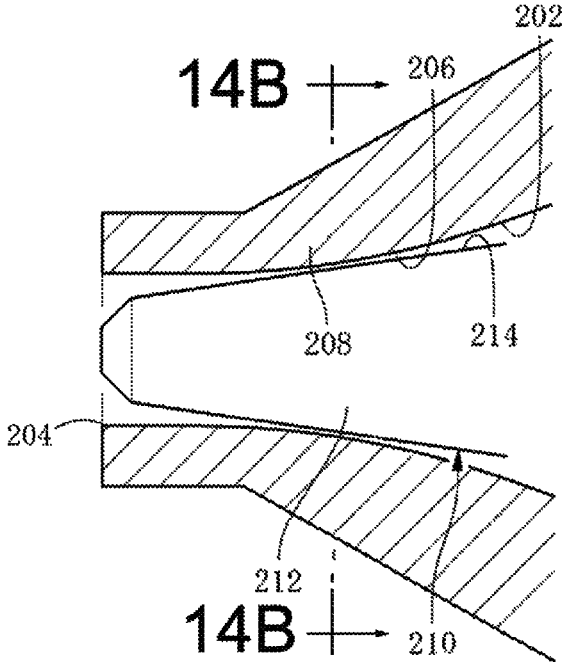
FIG. 14C is an enlarged view of FIG. 14A.
Figure 15:
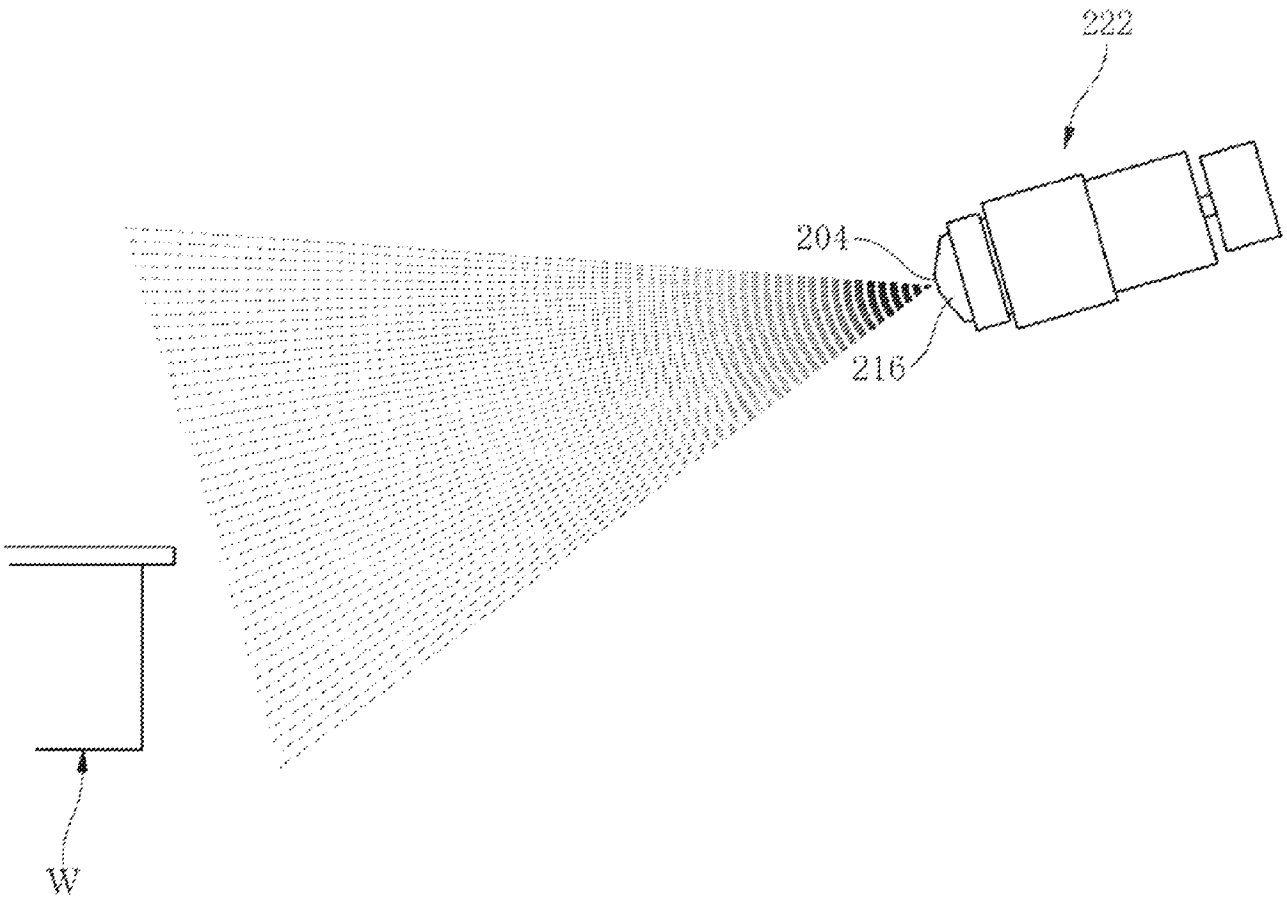
FIG. 15 is a view suitable for explaining an example of the use of the conventional air spray gun.
Figure 16A:
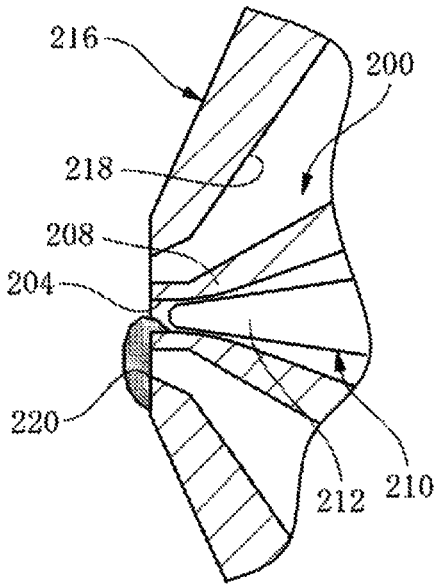
FIGS. 16A and 16B are views suitable for explaining problem points of the conventional air spray gun, wherein FIG. 16A indicates an example of leaking liquid blocking a part of an air jetting port, and FIG. 16B indicates an example of an irregular divergence in the direction of the liquid spray.
Figure 16B:
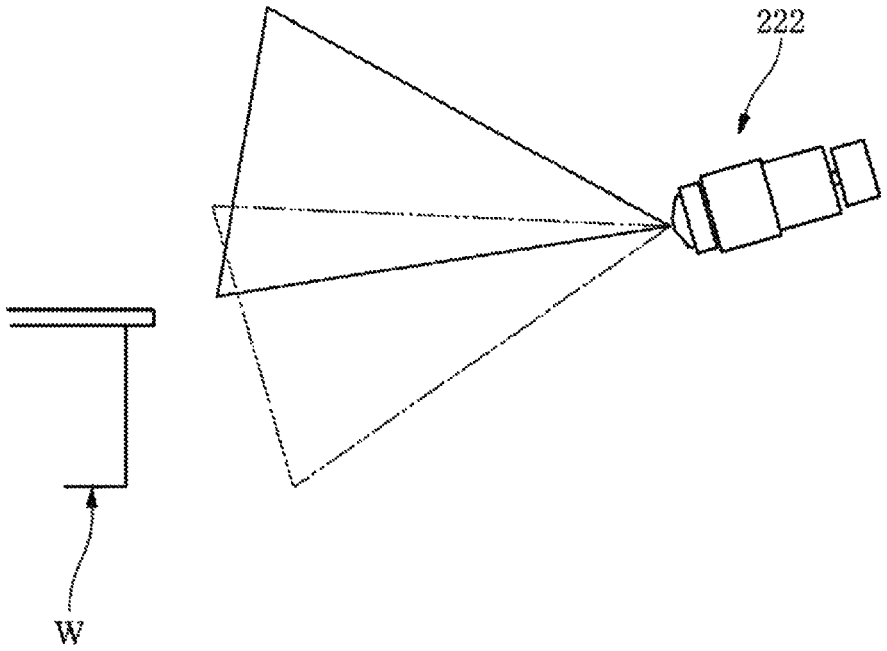

With the above embodiment, aperture S1 between the valve portion 68 and the restricting section 62 is limited to one location in the circumferential direction and, because it is given a consolidated form, when the total area (transverse cross-sectional area) of aperture S1 is made the same as that of the conventional spray gun shown in FIGS. 14A to 14C, it is possible to make that one opening in the circumferential direction larger. Aperture S1, which is produced in the spray gun of this embodiment, and aperture S1, which is produced in the conventionally structured spray gun shown in FIGS. 14A to 14C as Comparative Example, are respectively shown in FIGS. 6B and 6A.

As shown in Comparative Example in FIG. 6A, because circular aperture S1 is produced over the entire circumference between the male tapered valve portion 212 and the female tapered surface 206 of the nozzle 200, specifically the restricting section 208, even if a certain amount of total area (the total transverse cross-sectional area) is acquired for aperture S1 that determines the amount of liquid that is discharged, the size of the aperture at one location in the circumferential direction between the valve portion 212 and the restricting section 208 will be small. In comparison with that, as shown in FIG. 6B, with this embodiment, because that aperture S1 is consolidated at one location in the circumferential direction, when the total area of aperture S1 is the same, it is possible to secure a large aperture at one location in the circumferential direction.

As an example, with a conventional spray gun, for example, the size of aperture S1 that is required in order to discharge liquid at discharge-volume a (mg/s) was a maximum of 0.062 mm, but, with this embodiment, it is possible to make aperture S1 a maximum of 0.146 mm when discharging liquid at discharge-volume a (mg/s). In other words, with this embodiment, it is possible to secure an aperture size that, when discharging liquid at substantially the same discharge volume, is as much as 2.4 times larger in comparison to Comparative Example.

As noted above, with this embodiment, when the total area of aperture S1 is made the same as that of the conventional spray gun shown in FIGS. 14A to 14C, it is possible to make the aperture larger at one location in the circumferential direction and therefore, make it difficult for liquid to clog that opening. It is thus possible to resolve the conventional problem of being unable to spray coat liquids effectively due to liquid the clogging of microscopic gaps. And, when the size of the aperture at one location in the circumferential direction is made the same as that of a conventional spray gun, it is possible to make the total area of aperture S1 smaller. And due to that, it is possible to reduce the amount of liquid that is discharged (the amount sprayed).

Figure 7:
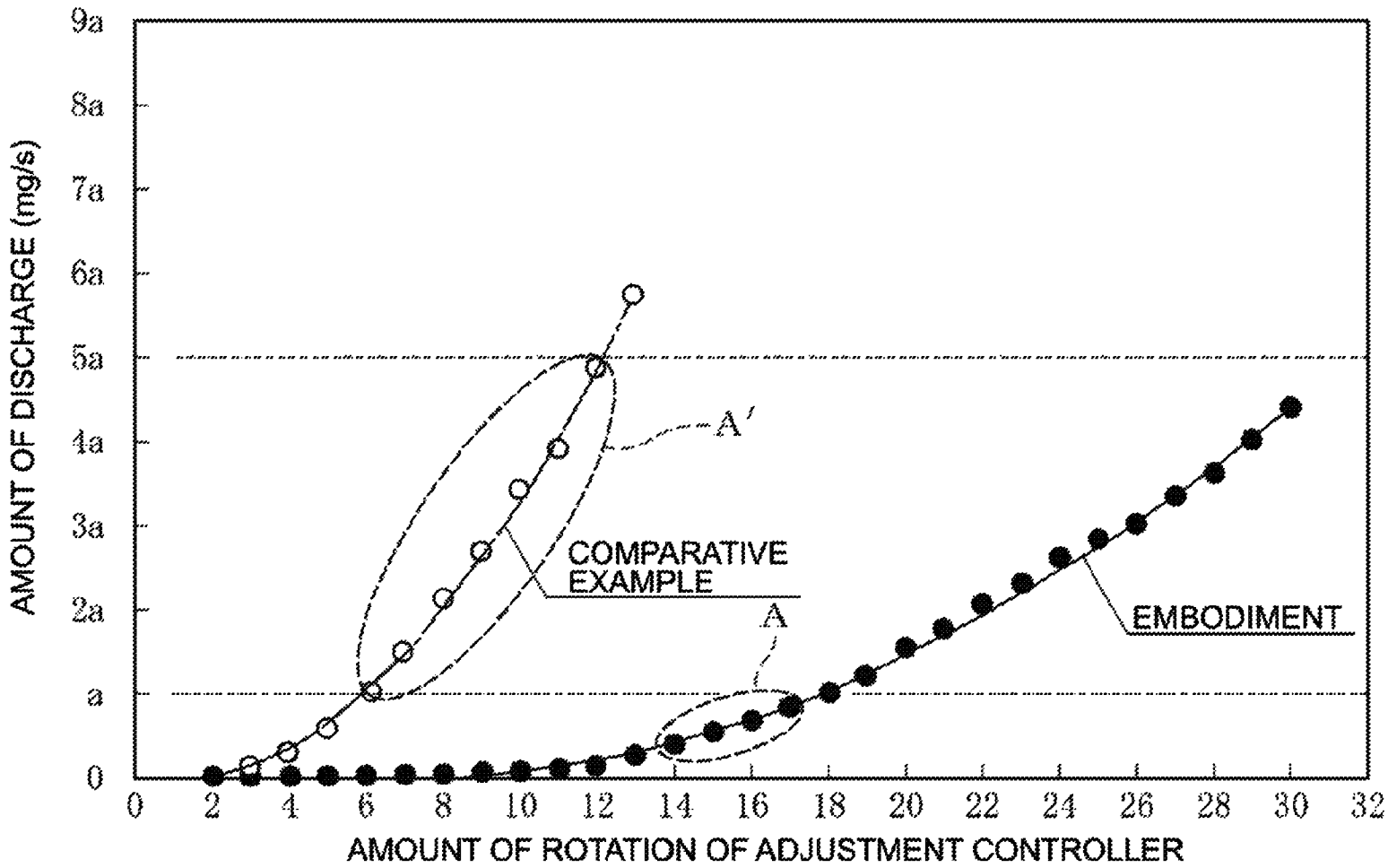
FIG. 7 is a graph showing the relationship between the aperture of the valve portion and the amount of discharge in the first embodiment in comparison with that of Comparative Example.

In FIG. 7, a graph is shown that indicates the relationship between the aperture of the valve portion 68 and the amount of liquid that is discharged when the aperture of the valve portion 68 is changed with the spray gun 10 in this embodiment, in other words when changing the size of aperture S1, in comparison with the conventionally structured spray gun shown in FIGS. 14A to 14C as Comparative Example. In that graph, the vertical axis shows the amount of liquid that is discharged, and the horizontal axis shows the aperture of the valve portion 68, specifically the amount of rotation of the dial-type adjustment controller 52 shown in FIG. 1 that changes that aperture. The numbers on the horizontal axis in the graph indicate the relative amount of rotation of the adjustment controller 52, with 1/16th of a rotation of the adjustment controller 52 taken as 1. That is, the greater the amount of rotation, the larger the number is, therefore, the larger the aperture of the valve portion 68 becomes.

As shown in FIG. 7, while the amount of needle valve retraction that is required in Comparative Example to discharge liquid at, for example, an amount of approximately a (mg/s), in other words, for when the amount of rotation of adjustment controller is around 6, the amount of needle valve refraction that is required with the spray gun 10 in this embodiment to discharge liquid of the same discharge amount of approximately a (mg/s), in other words the amount of rotation of the adjustment controller 52, is a larger number, at 18. Aperture S1 in Comparative Example in this case is the 0.062 mm shown in FIG. 6A, while aperture S1 in this embodiment is the 0.146 mm shown in FIG. 6B, so, as stated above, aperture S1 in this embodiment is approximately 2.4 times larger in comparison to Comparative Example.

With the spray gun of Comparative Example, the size of the aperture is at the lower allowable limit, and if aperture S1 becomes smaller than that, then there is the possibility of it becoming clogging by liquid. In the case of a conventional spray gun, it was therefore necessary to spray coat liquid using an aperture that is larger than that. And, in that case, it was necessary to spray coat liquid in a range greater than discharge-volume a (mg/s), in other words, in the range shown in A' in FIG. 7.

However, in the case of this embodiment, aperture S1 is larger in comparison with Comparative Example, and, due to that, it is possible to spray coat using an amount of liquid that is smaller than a (mg/s). That is, it is possible to spray coat liquid in range A shown in FIG. 7.

As noted above, with this embodiment, by being able to make aperture S1 larger, it is possible to reduce the amount of liquid that is discharged (the amount sprayed) and, therefore, for example, when spray coating liquid onto a small target object, it becomes possible to bring the position of the spray gun closer to the target object and to spray coat that liquid onto the target object from point-blank range. In that case, it is possible to reduce the dispersion of the mist flow up until the sprayed liquid reaches the target object and it is thus possible to more effectively spray coat liquid onto that target object. Liquid scatter can also be minimized as much as possible and liquid loss can thus be minimized. Further, because, at a position close to the target object, it becomes possible to spray coat more appropriately and also with a smaller amount of liquid, it is possible to resolve the conventional problems of an uneven application and the dripping of that liquid that does adhere to the target object that can occur when an excessive amount of liquid is spray coated at a position close to the target object.

As is clear from FIG. 7, the curve of the change in the discharge volume with the spray gun 10 in this embodiment is a smooth slope in comparison with Comparative Example. Thus, in the case of the conventional spray gun shown as Comparative Example, the amount of liquid that is discharged changes greatly with just a slight difference in the position of the needle valve. The spray gun 10 in this embodiment, however, has the characteristic that, even if the position of the needle valve 20 changes, the amount of liquid does not change greatly, thus making control of the amount of liquid that is discharged easy.

Another major characteristic of this embodiment is the point that the closure section 80 is provided upstream of the valve portion 68. This closure section 80 involves the O-ring 78, as the elastic seal member that is retained in the needle valve 20, coming in contact with and being elastically deformed by the contact surface 66 on the nozzle 16 in the axial direction in order to close the liquid passage 24 that leads the liquid to the outlet 18. With this embodiment, it is possible to resolve the problems that occur with a conventional spray gun, specifically of gaps being created at the forward end of the needle valve between the valve portion and the restricting section due to damage, etc., that occurs to the valve portion and/or the restricting section, and of, in spite of the liquid passage being in a closed state, there being leakage from those gaps, and the liquid outlet and the air jetting port being partially blocked due to that leakage.

Figure 8A:
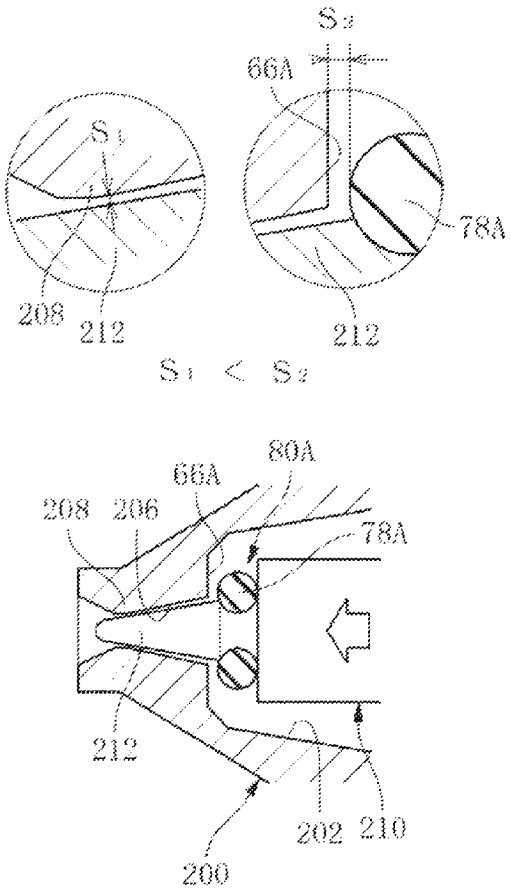
FIGS. 8A and 8B are views suitable for explaining the action of the air spray gun of Comparative Example when the needle valve is moved forward, wherein FIG. 8A indicates the state where the rear end of the valve portion is positioned to the rear of the restricting section, and FIG. 8B indicates the state where the needle valve is moved forward from its state in FIG. 8A.
Figure 8B:
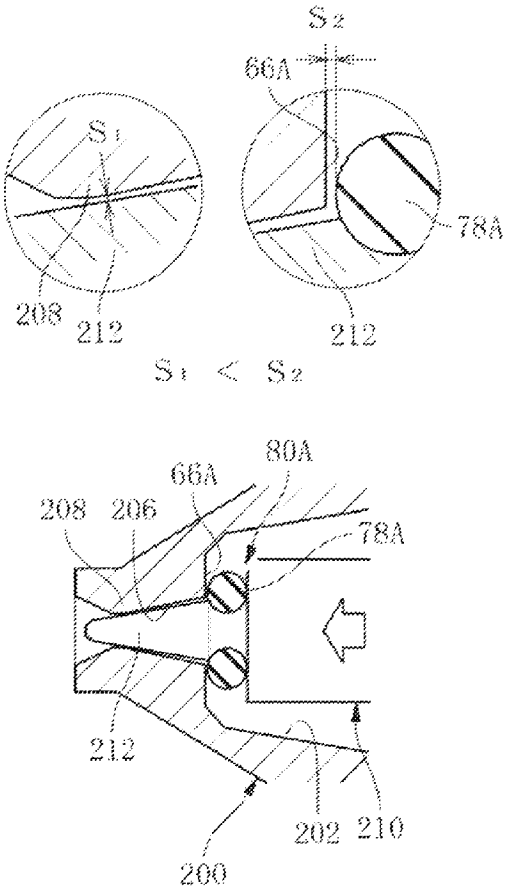
Figure 9A:
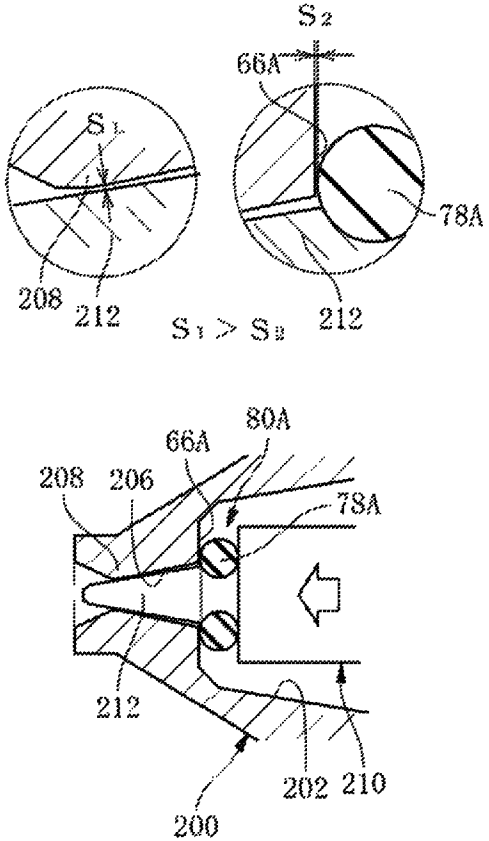
FIGS. 9A-9C are views suitable for explaining the action of the air spray gun of Comparative Example in continuation of FIG. 8B, wherein FIG. 9A indicates the state where an aperture S2, which is formed between the O-ring of the needle valve and the contact surface, is smaller than the aperture S1, which is formed between the valve portion and the restricting section, FIG. 9B indicates, in continuation from FIG. 9A, the state where the O-ring of the needle valve and the contact surface are in contact, and FIG. 9C indicates, in continuation from FIG. 9B, the state where the O-ring of the needle valve is elastically deformed while the valve portion and the restricting section are in contact.
Figure 9B:
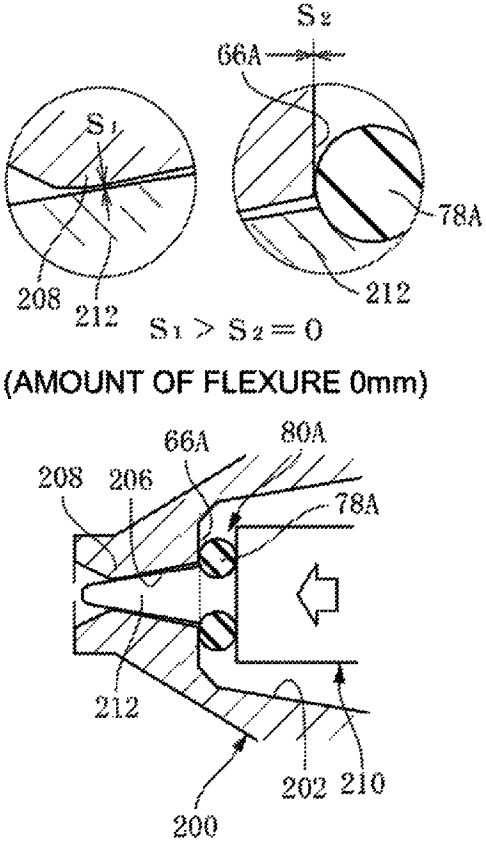
Figure 9C:
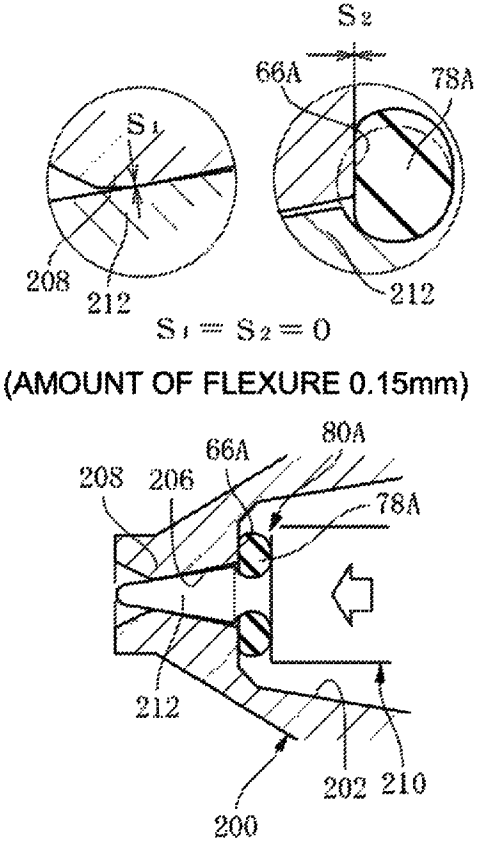

Naturally, it is possible to consider providing the conventionally structured spray gun shown in FIGS. 14A to 14C with this kind of closure section. However, in actuality, it is difficult to provide this kind of closure section in the case of a conventionally structured spray gun. FIGS. 8A and 8B as well as FIGS. 9A to 9C are a sequence of explanatory views that show Comparative Example of a spray gun in order to clarify the reason for that. As shown in FIGS. 8A and 8B, a closure section 80A is provided upstream of the valve portion 212 and, when closing the liquid passage 202 through contact between an O-ring 78A and a contact surface 66A in accordance with the forward movement of the needle valve 210, at the point that the O-ring 78A comes in contact with the contact surface 66A, it is necessary to produce more than a certain size for aperture S1 between the valve portion 212 and the restricting section 208.

But even after the O-ring 78A comes in contact with the contact surface 66A, it is necessary to elastically deform that O-ring in order to sufficiently seal the liquid passage 202 closed at the closure section 80A. And to do so, it is necessary to make the needle valve 210 move forward a designated stroke even after the O-ring 78A comes in contact with the contact surface 66A. However, in the case of Comparative Example, as shown in FIG. 9B, at the point that the O-ring 78A comes in contact with the contact surface 66A, only a slight aperture S1 is produced between the valve portion 212 and the restricting section 208. If, for example, aperture S1 between the restricting section 208 and the valve portion 212 is the smallest aperture possible, as soon as the needle valve 210 begins to move forward, the valve portion 212 will come in contact with the restricting section 208 in the axial direction, and it will not be possible to move the needle valve 210 any further forward than that. Thus, it is not possible to elastically deform the O-ring 78A. Due to that, it becomes necessary to secure more than a certain size for aperture S1 between the valve portion 212 and the restricting section 208 at the point that the O-ring 78A comes in contact with the contact surface 66A.

However, it is not possible to use the aperture S1, of more than a certain size, that was secured between the valve portion 212 and the restricting section 208 as the aperture for the adjustment of the volume of liquid flow after the O-ring 78A comes in contact with the contact surface 66A. That is because, once the O-ring 78A comes in contact with the contact surface 66A, the liquid passage 202 is thus closed upstream of the valve portion 212, in other words, by the closure section 80 A. Therefore, even if aperture S1 between the restricting section 208 and the valve portion 212 is narrowed along with the forward movement of the needle valve 210, it does not result in the adjustment of the volume of liquid flow, and the range of the forward movement of the needle valve 210 after the O-ring 78A comes in contact with the contact surface 66A thus becomes a range where it is not possible to adjust the volume of liquid flow.

The above indicates the case when the needle valve 210 is moved forward, but the situation is the same when the needle valve 210 is retracted. From the situation shown in FIG. 9C, even if aperture S1 between the restricting section 208 and the valve portion 212 is enlarged along with the retracting movement of the needle valve 210, as long as the O-ring 78A is in contact with the contact surface 66A, specifically, up to the time that the shape of the O-ring 78A has been restored from a state of elastic deformation and immediately before it disengages from the contact surface 66A, the adjustment of the volume of liquid flow is not accomplished by the movement of the valve portion 212.

Further, even if the O-ring 78A disengages from the contact surface 66A, up until the point that aperture S2 between the O-ring 78A and the contact surface 66A becomes larger than aperture S1 between the valve portion 212 and the restricting section 208, in other words in the situation shown in FIG. 9A, the volume of liquid flow is substantially determined by aperture S2 between the O-ring 78A and the contact surface 66A. Therefore, during that period, the adjustment of the volume of liquid flow is not accomplished through a change in aperture S1 between the valve portion 212 and the restricting section 208.

This point is the same even when the needle valve 210 is moved forward as well; in the range wherein, as shown in FIGS. 9A and 9B, aperture S2 between the O-ring 78A and the contact surface 66A becomes smaller than aperture S1 between the valve portion 212 and the restricting section 208, the adjustment of the volume of liquid flow is not accomplished by aperture S1 between the valve portion 212 and the restricting section 208. The problem above is caused by the enlargement and reduction in the size of aperture S1 in accordance with the valve portion 212 coming in contact with and disengaging from the restricting section 208 in the axial direction so as to open and close the aperture S1 between the valve portion 212 and the restricting section 208.

Nevertheless, with the spray gun 10 in this embodiment, it is possible to effectively resolve this kind of problem. That is, with this embodiment, the O-ring 78 comes in contact with the contact surface 66 when the needle valve 20 is moved forward, in short, because, before aperture S2 between the O-ring 78 and the contact surface 66 becomes zero, the size of aperture S1 between the valve portion 68 and the restricting section 62 in the radial direction is made smaller than S2, and adjustment of the volume of liquid flow is then accomplished by that aperture S1. And, even with the retracting movement of the needle valve 20, the O-ring 78 and the contact surface 66 are disengaged before the size of aperture S1 becomes larger than zero, in other words, S2 becomes larger than zero first and, because S1<S2 after that, the volume of liquid flow can be adjusted in accordance with the size of aperture S1 being enlarged and reduced.

Therefore, with this embodiment, it is possible to prevent leaks at the forward end of the needle valve 20 and to close the liquid passage 24 effectively, and it is possible to prevent the problem, despite the liquid passage being closed, of liquid leaking due to microscopic gaps generated in the needle valve between the valve portion and the restricting section. Therefore, it is possible to resolve the problem of becoming unable to spray coat effectively, etc., due to the coagulation of leaking liquid. It is also possible to use the valve portion 68 and the restricting section 62 to adjust and control, with high precision, the amount of liquid that passes through the liquid passage 24 to the outlet 18.

And, in this embodiment, because a stopper mechanism that controls displacement of the O-ring 78 is formed by the movable-side contact section 74 that ascends outward in the radial direction at the rear of the male joint 70 of the needle valve 20 and by the fixed-side contact section 64 that is provided on the nozzle 16, excessive deformation of the O-ring 78 can be prevented and it is possible to enhance the durability of the O-ring 78.

Figure 10A:
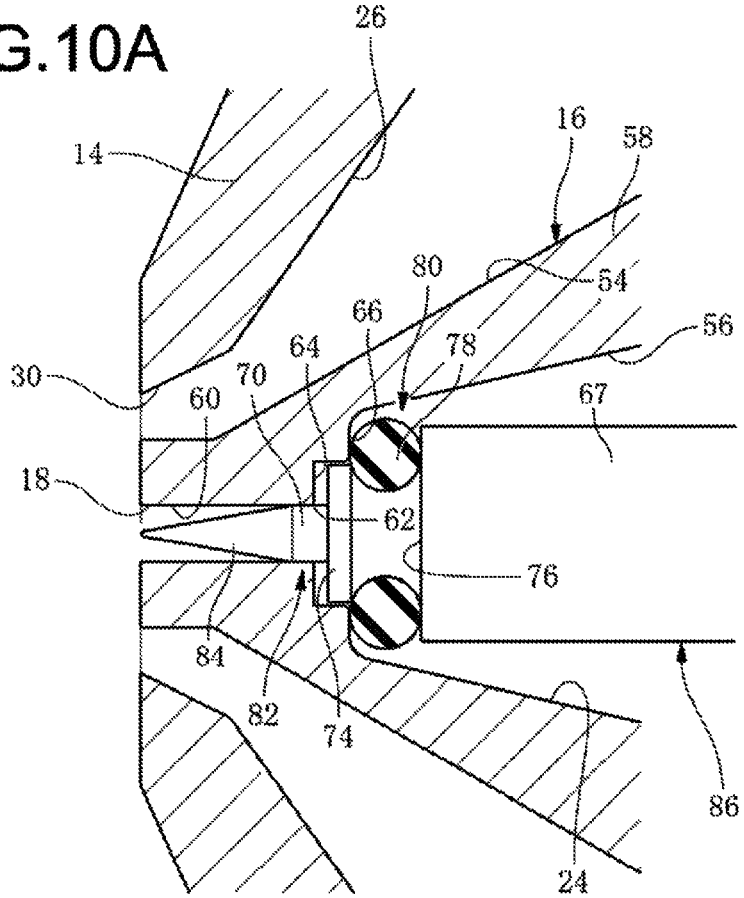
Figure 10B:
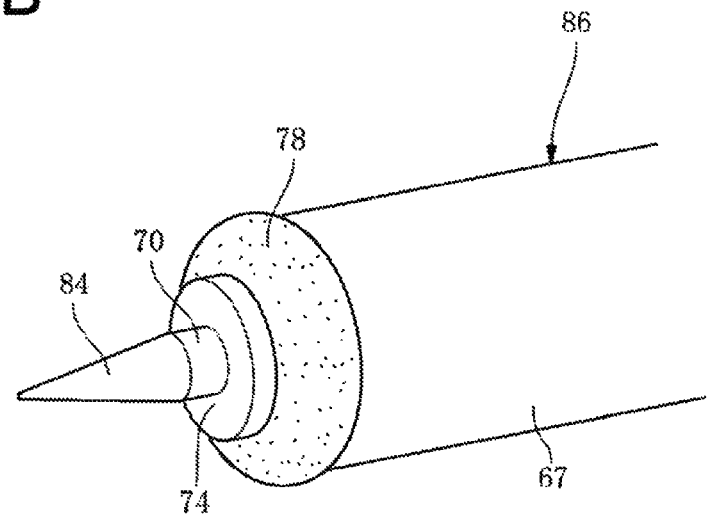

FIGS. 10A and 10B show another embodiment of the spray gun in this invention. In the following explanation, for those components and parts that are essentially the same as the above-mentioned embodiments, the same numbering as the above-mentioned embodiments has been used in the drawing and separate explanations have been omitted. This example, as shown in FIG. 10A, is an example of aperture S1 being produced in the radial direction over the entire circumference between a valve portion 84 as an overall conical shape and the restricting section 62. Even when made in this way, with this embodiment, it is possible to effectively prevent leakage from between the valve portion 84 and the restricting section 62 because the liquid passage 24 is closed by the closure section 80 at the forward end of a needle valve 86 (refer to FIG. 10B). Note that the valve portion 84 may have a pyramid shape, a frustoconical shape or a truncated pyramid shape other than a conical shape.

Figure 11A:
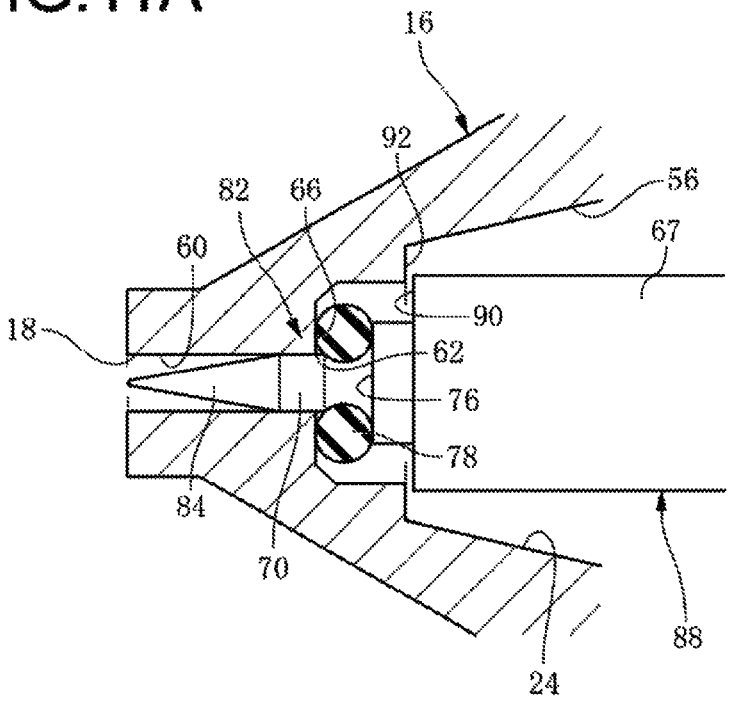
FIGS. 11A and 11B are longitudinal cross-section views showing a principle part of an air spray gun as yet another embodiment of the present invention, wherein FIG. 11A indicates the state where an O-ring of a needle valve is in contact with a contact surface, and FIG. 11B indicates the state where the needle valve is moved to the rear from its state in FIG. 11A.
Figure 11B:
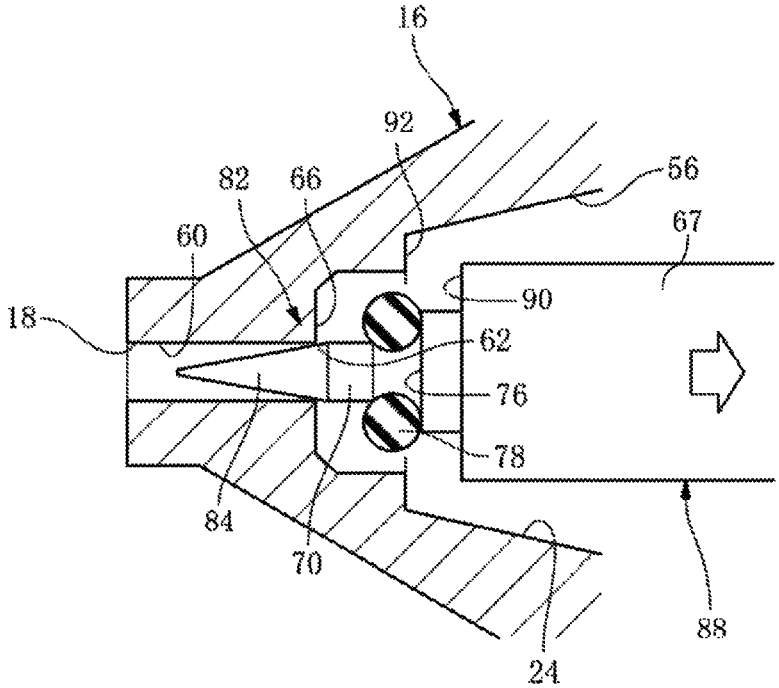

FIGS. 11A and 11B show another embodiment of the spray gun in this invention. While, with the above-mentioned embodiment, the movable-side contact section 74 is provided in a position in front of the O-ring 78, with this embodiment, the movable-side contact section is provided in a position to the rear of the O-ring 78 in relation to the example of the needle valve 86 in FIGS. 10A and 10B, and the fixed-side contact section is provided in opposition to the movable-side contact section. That is, with this embodiment, the outer circumference portion of the front surface of the needle body 67 of a needle valve 88 serves as a movable-side contact section 90 and a fixed-side contact section 92 is provided further to the rear and on the outer peripheral side of the contact surface 66.

And, as shown in FIG. 11A, when the O-ring 78 of the needle valve 88 and the contact surface 66 come in contact, the liquid passage 24 is closed by the joint between the male joint 70 and the restricting section 62 as well as the contact between the contact surface 66 and the O-ring 78. Conversely, as shown in FIG. 11B, the liquid passage 24 is opened by moving the needle valve 88 to the rear. Also, like in the above-mentioned first embodiment, a stopper mechanism that controls the excessive deformation of the O-ring 78 is formed by the movable-side contact section 90 and the fixed-side contact section 92. Thus, the same effect as the above-mentioned first embodiment can be demonstrated even with the spray gun in this embodiment that is structured in this particular way.

Figure 12A:
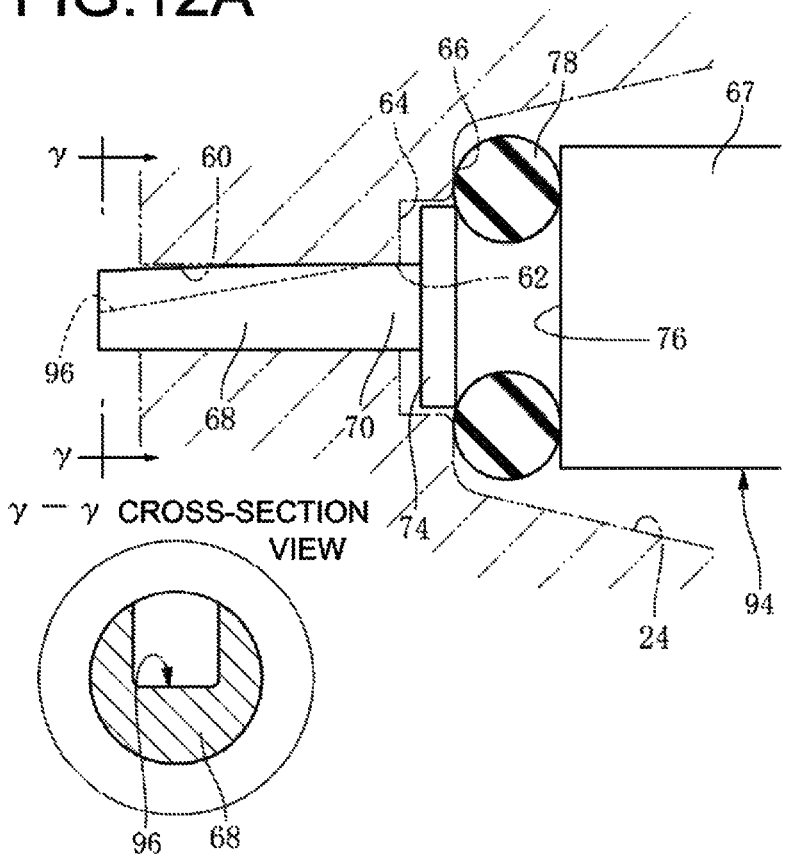
Figure 12B:
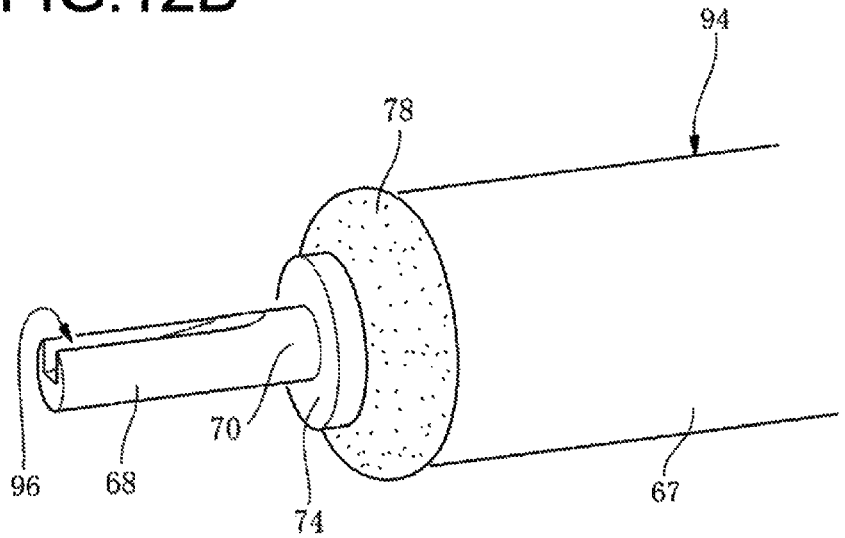

Next, FIGS. 12A and 12B show a spray gun in still another embodiment of this invention. This is an example of a needle valve 94 in this embodiment being provided with a groove 96 having U-shaped cross section in place of the sloped surface 72 that is provided on the shaft that forms the valve portion 68 in the above-mentioned primary embodiment. Here, the groove 96 is open at the tip of the valve portion 68, and is given a shape whereby the depth of the groove becomes progressively deeper toward that tip. Through this, an overall aperture is formed between the groove 96 and the restricting section 62 and, if accomplished in this way, the width of aperture S1 produced between the valve portion 68 and the restricting section 62 (the width in the horizontal direction in the y-to-y cross-section view in FIG. 12A) can be made smaller in comparison with the above-mentioned first embodiment shown in FIG. 1 to FIGS. 9A-9C, and an effect can be achieved of making the size of aperture S1 (the height in the vertical direction in the y-to-y cross-section view in FIG. 12A) even larger by that same amount.

Figure 13A:
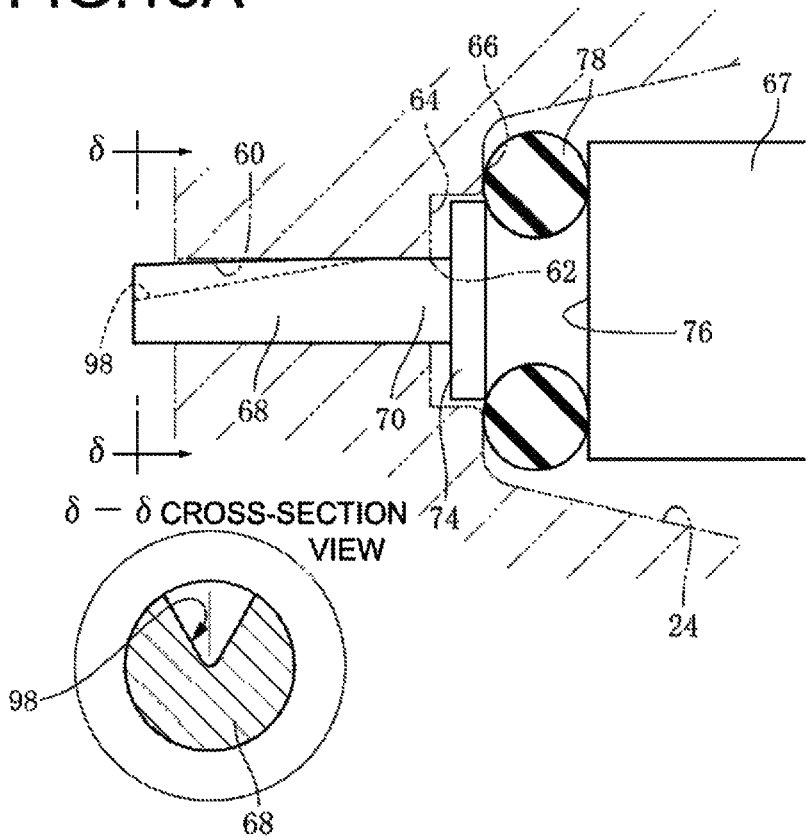
Figure 13B:
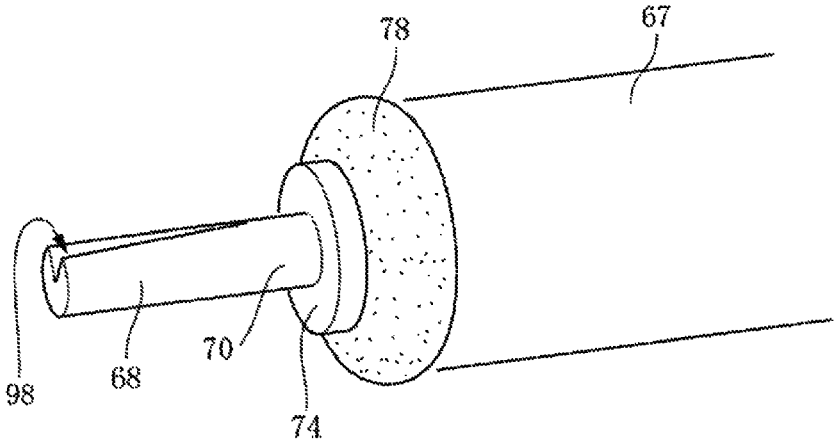

Further, rather than that kind of U-shaped groove 96, it is possible, as shown in FIGS. 13A and 13B, to provide a groove 98 having V-shaped cross section in the valve portion 68. Alternatively, it is also possible to provide a groove with other cross-sectional shape in the valve portion 68. In the example shown in FIGS. 13A and 13B, the depth of the V-shaped groove 98 is made progressively deeper and, at the same time, the width of the groove becomes progressively wider toward the tip.

Embodiments of this invention are described in detail above, but they are ultimately only examples. For instance, all of the above-mentioned embodiments use an O-ring as the elastic seal member, but it is possible to use an elastic seal member of a shape and form other than an O-ring and, depending upon the case, rather than providing an elastic seal member other than an O-ring on the needle valve 20 as mentioned above, it is possible to provide it on the nozzle 16 and then provide the contact surface in opposition to that on the needle valve 20.

Also with this invention, it is possible to use various shapes for the valve portion 68 other than the example mentioned above.

Furthermore, the above-mentioned embodiments are examples of applying this invention to an air spray gun, but it can also be applied to an airless type of hydraulic spray gun, etc., and it is also possible to apply this invention to spray guns used to spray coat a variety of types of liquids.

Further, with the above-mentioned embodiments, the elastic seal member 78 is retained in a state of positioning on the outer peripheral surface of the needle valve 20 in the axial direction, but, for example, the elastic seal member 78 may be retained in a position on the nozzle 16 by providing a groove on the inner peripheral surface of the nozzle 16 to fit and retain it in. In addition, rather than providing a groove in order to position the elastic seal member 78 in the axial direction on the outer peripheral surface of the needle valve 20 or the inner peripheral surface of the nozzle 16, it is possible to attach the elastic seal member 78 so as to be movable in the axial direction.

Also, this invention can be structured of a form that includes various changes as long as it is within a scope that does not deviate from the intended meaning

What is claimed is:

1. A spray gun having a tubular nozzle with an outlet of a liquid in its tip and a needle valve inserted inside the nozzle, the spray gun that atomizes the liquid discharged from the outlet and spray coats the liquid on a target object, comprising:

a fixed-side restricting section provided on an inner circumference of the nozzle;

a valve portion provided on a tip of the needle valve as a movable-side restricting section that forms an aperture between the valve portion and the fixed-side restricting section through which the liquid passes and that changes an amount of the liquid that passes through the aperture to reach the outlet by enlarging the aperture along with retracting movement of the needle valve and by narrowing the aperture along with forward movement thereof, the aperture being formed between the fixed-side restricting section and the valve portion in a radial direction by the fixed-side restricting section being situated in a position that is not in contact with the valve portion in an axial direction and that is outward from the valve portion entirely in the radial direction;

an elastic seal member that comes in contact and is elastically deformed in the axial direction between the nozzle and the needle valve when the needle valve is moved forward so as to provide a closure section which closes a liquid passage for the liquid that moves toward the outlet upstream of the valve portion;

a nozzle hole having the outlet at its tip that is provided on the inner circumference of the tip of the nozzle for inserting the valve portion in the axial direction and whose rear end constitutes the fixed-side restricting section;

a female joint that is provided by at least a rear portion of the nozzle hole which includes the fixed-side restricting section and that extends in a straight form in the axial direction over an entire circumference thereof; and a male joint that is provided on a rear portion of the valve portion of the needle valve and extends in a straight form in the axial direction over an entire circumference thereof while fitting into the female joint, the female joint and male joint forming a straight joint, wherein the straight joint is arranged such that, when the needle valve is moved forward, the male joint is inserted into and fits inside the female joint before the elastic seal member comes in contact between the nozzle and the needle valve as well as after the valve portion reaches a position where the aperture between the valve portion and the fixed-side restricting section is a smallest aperture possible, and a state of joint is retained until the elastic seal member comes in contact and is elastically deformed between the nozzle and the needle valve.

2. The spray gun according to claim 1, further comprising a stopper mechanism that, when the needle valve is moved forward, stops the forward movement of the needle valve when the elastic seal member of the closure section comes in contact between the nozzle and the needle valve and is elastically deformed to a set amount of deformation, and that controls displacement of the elastic seal member.

3. The spray gun according to claim 2, wherein the stopper mechanism comprises:

a movable-side contact section that ascends outward in the radial direction at a rear of the male joint of the needle valve; and a fixed-side contact section that is provided on the nozzle in opposition to the movable-side contact section in the axial direction and comes in contact with the movable-side contact section.

4. The spray gun according to claim 1, wherein the elastic seal member is fitted externally onto the needle valve, while a movable-side contact surface and a fixed-side contact surface are provided respectively on an outer peripheral surface of the needle valve and on an inner peripheral surface of the nozzle such that the elastic seal member is sandwiched so as to come in contact and be elastically deformed therebetween in the axial direction.

5. The spray gun according to claim 1, wherein the valve portion of the needle valve has a tapered shape that includes a sloped surface on at least one location in a circumferential direction and whose shape causes a distance in the radial direction from the fixed-side restricting section to progressively increase toward a tip of the valve portion, and the aperture overall is formed between the sloped surface and the fixed-side restricting section.

6. The spray gun according to claim 5, wherein the valve portion of the needle valve has an arched cross section, and the sloped surface has a flat face that extends in a chord direction when viewed in the axial direction.

7. The spray gun according to claim 1, wherein the valve portion of the needle valve has a groove in at least one location in a circumferential direction whose depth becomes progressively larger toward a tip of the valve portion, and the aperture overall is formed between the groove and the fixed-side restricting section.

* * * * *